US009796204B2

(12) United States Patent
Tompkin et al.

(10) Patent No.: US 9,796,204 B2
(45) Date of Patent: Oct. 24, 2017

(54) SECURITY ELEMENT

(71) Applicant: OVD Kinegram AG, Zug (CH)

(72) Inventors: Wayne Robert Tompkin, Baden (CH); Harald Walter, Horgen (CH); Olga Kulikovska, Berlin (DE); Jorg Fischer, Berlin (DE); Andre Leopold, Berlin (DE)

(73) Assignee: OVD KINEGRAM AG, Zug (CH)

( * ) Notice: Subject to any disclaimer, the term of this patent is extended or adjusted under 35 U.S.C. 154(b) by 535 days.

(21) Appl. No.: 14/354,361

(22) PCT Filed: Oct. 26, 2012

(86) PCT No.: PCT/EP2012/071310

§ 371 (c)(1),
(2) Date: Apr. 25, 2014

(87) PCT Pub. No.: WO2013/060874

PCT Pub. Date: May 2, 2013

(65) Prior Publication Data

US 2014/0300095 A1 Oct. 9, 2014

(30) Foreign Application Priority Data

Oct. 27, 2011 (DE) ..... 10 2011 117 044

(51) Int. Cl.
*B42D 25/00* (2014.01)
*B42D 25/30* (2014.01)
(Continued)

(52) U.S. Cl.
CPC ..... *B42D 25/30* (2014.10); *B42D 25/00* (2014.10); *B42D 25/29* (2014.10); *B42D 25/342* (2014.10);
(Continued)

(58) Field of Classification Search
CPC ..... B42D 25/00; B42D 2033/46
See application file for complete search history.

(56) References Cited

U.S. PATENT DOCUMENTS

2007/0058260 A1* 3/2007 Steenblik ..... B42D 25/43 359/626
2008/0094713 A1 4/2008 Tompkin et al.
(Continued)

FOREIGN PATENT DOCUMENTS

DE 102005039320 2/2001
DE 102004059798 6/2006
(Continued)

OTHER PUBLICATIONS

Jan van den Berg, "3D Photo ID," Optical Document Security, pp. 1-8, (Jan. 2008).

*Primary Examiner* — Kyle Grabowski
(74) *Attorney, Agent, or Firm* — Hoffmann & Baron, LLP

(57) ABSTRACT

The invention relates to a security element (1). The security element (1) has a viewing side and a back side that is opposite the latter. The security element comprises at least one luminous layer (2) that can provide light (20), and at least one mask layer (4) that, when the security element (1) is viewed from the viewing side, is arranged in front of the at least one luminous layer (2). The at least one mask layer (4) has at least one opaque region (5) and at least two transparent openings (41, 42). The at least two transparent openings (41, 42) has a substantially higher transmittance than the at least one opaque region (5) in respect of light (20) provided by the at least one luminous layer (2), preferably a transmittance that is at least 20% higher, particularly preferably a transmittance that is at least 50% higher.

37 Claims, 35 Drawing Sheets

(51) Int. Cl.

| | |
|---|---|
| ***B42D 25/29*** | (2014.01) |
| ***B42D 25/342*** | (2014.01) |
| *B42D 25/328* | (2014.01) |
| *B42D 25/382* | (2014.01) |
| *B42D 25/387* | (2014.01) |

(52) U.S. Cl.

CPC ..... *B42D 25/328* (2014.10); *B42D 25/382* (2014.10); *B42D 25/387* (2014.10); *B42D 2033/04* (2013.01); *B42D 2033/06* (2013.01); *B42D 2033/08* (2013.01); *B42D 2033/10* (2013.01); *B42D 2033/20* (2013.01); *B42D 2033/24* (2013.01); *B42D 2033/26* (2013.01); *B42D 2033/46* (2013.01); *B42D 2035/20* (2013.01); *B42D 2035/34* (2013.01); *Y10T 29/49826* (2015.01)

(56) References Cited

U.S. PATENT DOCUMENTS

| | | | | |
|---|---|---|---|---|
| 2008/0169639 | A1* | 7/2008 | Eichenberger ..... | B42D 25/29 283/85 |
| 2008/0259416 | A1* | 10/2008 | Peters ..... | B42D 25/328 359/2 |
| 2009/0121473 | A1 | 5/2009 | Camus et al. | |
| 2010/0001077 | A1 | 1/2010 | Kluge | |
| 2010/0277805 | A1 | 11/2010 | Schilling et al. | |
| 2011/0212387 | A1 | 9/2011 | Hansen et al. | |
| 2012/0174447 | A1 | 7/2012 | Vincent | |
| 2012/0189159 | A1* | 7/2012 | Vincent ..... | B42D 25/342 382/100 |
| 2014/0175785 | A1 | 6/2014 | Kaule et al. | |

FOREIGN PATENT DOCUMENTS

| | | |
|---|---|---|
| DE | 102007029203 | 1/2009 |
| DE | 102008033716 | 9/2009 |
| DE | 102008052067 | 4/2010 |
| WO | WO 2006/024478 | 3/2006 |
| WO | WO 2007/087984 | 9/2007 |
| WO | WO 2009/139396 | 11/2009 |
| WO | WO 2011/007344 | 1/2011 |

* cited by examiner

SECURITY ELEMENT

This application claims priority based on an International Application filed under the Patent Cooperation Treaty, PCT/EP2012/071310, filed on Oct. 26, 2012, and German Application No. DE 102011117044.1, filed on Oct. 27, 2011.

BACKGROUND OF THE INVENTION

The invention relates to a security element and to a security document equipped with such a security element, to a method for producing such a security element, and to a transfer foil having such a security element.

There are known security elements, for the identification marking of security documents, by which it is sought to improve the protection against falsification. Some of these security elements make use of an arrangement of microlenses, such as, e.g., the multilayer body described in the international patent application WO 2007/087984 A1. Frequently, however, in unfavorable light conditions, the variations of the optical appearance that can be produced with these can be perceived only with difficulty, and are not sufficiently distinctive for the "man on the street".

DE 10 2008 033 716 B3 describes a value document or security document, having a document body, realized in which there is a light conducting structure that is realized for conducting light by means of total reflection in its boundary layers. In this case, the conducting of light is rendered possible in a plane that is substantially parallel to a top side of the document body.

SUMMARY OF THE INVENTION

The object of the invention is now to provide a flexible security element that exhibits optical effects that are easily perceived by all and that, at the same time, are surprising or unexpected, and therefore easily striking.

The object is achieved by a security element, wherein the security element has a viewing side and a back side that is opposite the latter, wherein the security element comprises at least one luminous layer that can emit or provide light, and at least one mask layer that, when the security element is viewed from the viewing side, is arranged in front of the at least one luminous layer, wherein the at least one mask layer has at least one opaque region and at least two transparent openings, and wherein the at least two transparent openings has a substantially higher transmittance than the at least one opaque region in respect of light emitted or provided by the at least one luminous layer, preferably a transmittance that is at least 20%, particularly preferably at least 50% higher. The object is additionally achieved by a security document, in particular a banknote, a monetary instrument or a paper document, having at least one such security element, wherein the security element can be viewed from its viewing side. The object is also achieved by a method for producing a security element, comprising the following steps: providing a flexible, multilayer foil body having at least one luminous layer that can emit or provide light, and having at least one mask layer that, when the security element is viewed from the viewing side, is arranged in front of the at least one luminous layer; and realizing at least two transparent openings in the at least one mask layer, with the result that the at least one mask layer has at least one opaque region and at least two transparent openings, wherein the at least two transparent openings has a substantially higher transmittance than the at least one opaque region in respect of light emitted or provided by the at least one luminous layer, preferably a transmittance that is at least 20%, particularly preferably at least 50% higher. The object is further achieved by a transfer foil having at least one security element according to one of claims 1 to 34, wherein the at least one security element is arranged on, and can be separated from, a carrier foil of the transfer foil.

The particular optical effects that can be created in particular by the interaction of a self-luminous luminous layer, i.e. a luminous layer that generates and radiates light, or a luminous layer that provides light (e.g. a backlit transparent layer) and a mask layer that covers the luminous layer can thus be used in a security element. In this case, these easily perceived optical effects are clearly visible when the luminous layer provides light or, in an active state, emits light, and are invisible, or scarcely visible, when the luminous layer does not provide light or, in an inactive state, does not emit light. A challenge in this case consists, inter alia, in keeping the thickness of such a security element as small as possible, so as to enable the security element to be arranged on or in a security document in a manner suitable for practical application.

The optical impression of the security element is thus determined by the design of the at least one luminous layer and/or the distribution of the transparent openings of the at least two arrangements and the at last one opaque region.

Owing to the arrangement of the layers, the light relevant to the desired effect preferably passes through the security element substantially in a direction perpendicular to the top side of the security element. There is no need for total reflection at any boundary surfaces whatsoever.

The mask layer allows light, provided or emitted by the luminous layer, to pass considerably better through its transparent openings than through its opaque regions. It is advantageous if the at least one opaque region blocks, or at least substantially weakens, light provided or emitted by the at least one luminous layer, and preferably has a transmittance of at most 20%, more preferably of at most 10%, and yet more preferably of at most 5%, and the at least two transparent openings substantially allow the passage of light provided or emitted by the at least one luminous layer, and preferably have a transmittance of at least 50%. Preferably, the opaque regions of the mask layer are completely non-transparent to light, i.e. having a transmittance of at most 5%, while the transparent openings allow light to pass almost unweakened, i.e. having a transmittance of at least 70%. Preferably, the openings are realized as window openings in the mask layer, i.e. as holes through the mask layer.

The security element is preferably a security element for the identification marking of a security document and increasing the security against falsification of the latter, in particular of a banknote, monetary instrument, check, taxation revenue stamp, postage stamp, visa, motor vehicle document, ticket or paper document, or of identification documents (ID documents), in particular a passport or ID card, identity card, driving license, bank card, credit card, access control pass, health insurance card, or of a commercial product, for the purpose of increasing the security against falsification and/or for the purpose of authentication and/or traceability (track & trace) of the commercial product or any chip cards and adhesive labels.

Preferably, the at least one luminous layer that is able to emit light is realized as a self-luminous luminous layer. A self-luminous luminous layer in this case is constituted by a luminous layer that emits light and, in particular, acts as an energy converter, which converts a primary energy into light energy. In this case, the primary energy used may be, in particular, an electric current, heat, a chemical decomposition process, or electromagnetic radiation that differs from the wavelength of the emitted light (for example, UV light, infrared light or microwave radiation).

Moreover, it is also possible for the luminous layer that can provide light to be a layer by which light that is incident on the back side is conducted to the mask layer. Thus, it may also be provided that the light source is not part of the security element and is provided, for example, by a light source of a body on to which the security element is laminated, or is constituted by an external light source on to which the security element is placed or against the backlight of which the security element is viewed. For this purpose, the luminous layer preferably has one or more transparent layers, which also may be realized as waveguides or light conductors. In the simplest case, the luminous layer thus has a transparent layer that is in direct contact with the back side of the security element, or beneath which a through-window is provided in the security element. The luminous layer may be, for example, a layer of a hot stamping foil, for example a protective varnish or, also, the replication layer itself. In this case, also, it is particularly advantageous if the luminous layer has one or more luminous elements. In this case, the luminous elements are constituted by transparent regions configured according to the shape of the luminous elements, and/or by regions of the luminous layer that are provided with light conductors, or waveguides, and that are preferably surrounded by opaque regions of the luminous layer.

It is possible for the at least one luminous layer to have a self-luminous display element that, in particular, converts electrical energy into light energy. Preferably, the luminous layer is composed of one or more luminous elements, which are each realized as self-luminous display elements. These self-luminous display elements may be an LED, in particular an OLED, or an LEEC, or QLED or back-lit LCD (OLED=Organic LED; LEEC=Light Emitting Electrochemical Cell; QLED=Quantum Dot Light Emitting Device; LCD=Liquid Crystal Display). Alternatively, the self-luminous display elements may be realized on the basis of electroluminescence. This includes thick-film, or powder, electroluminescence, thin-film electroluminescence and single-crystal electroluminescence. In particular, the display elements may be as electroluminescent foil (EL foil).

It is possible for an electrode of the display element to serve as the at least one mask layer or as an opaque intermediate layer, arranged between the at least one luminous layer and the at least one mask layer, that has at least one arrangement of translucent openings. This makes it possible to generate, for example, a periodicity in the light source. Preferably, it is a metal electrode, in particular a metallic reflection layer of an OVD. For example, such a metallic reflection layer is composed of aluminum, silver, gold or copper. A periodicity, or a grid, in particular a moiré grid, or a grid in the form of a revealer pattern, can be realized in a variety of ways on a full-area luminous OLED. One possibility is to incorporate an insulator layer into the OLED, wherein regions of the OLED that are coated with this insulator layer are not luminous, whereas regions that are left free are luminous. Alternatively, it is also possible to modify one of the transport layers, in particular the electron, or hole, transport layer, in particular by irradiation or action of a chemical, with the result that the transport properties are destroyed locally. This likewise has the effect that the treated regions are no longer luminous.

It is possible for the at least one luminous layer to have a luminescent display element, which can be excited by another light source to give light. Fluorescent and/or phosphorescent materials, which absorb incident light and reradiate it in the same or a different wavelength range, immediately and/or in a time-staggered manner, may be present as luminescent elements. The other light source may be realized as a constituent part of the security element. Alternatively, it is an external light source, by which the security element is irradiated, such as e.g. a UV lamp (UV=ultraviolet).

There are various possibilities for supplying energy to a self-luminous luminous layer, such that it gives light. In one embodiment, the luminous layer is excited to give light by means of electrical energy from an energy source. The luminous layer thus has a display element that converts electrical energy into light energy. In particular, piezoelectric and photovoltaic current sources, batteries, capacitors, super-capacitors, etc. may be cited as preferred energy sources for the luminous layer. The energy may also be extracted from an electric field via an appropriate antenna, e.g. an RFID antenna. Preferably, these energy sources are integrated into the security element or the security document, or connected to it via an energy line. As an alternative to this, the energy source may also be arranged outside of the security element/document, e.g. in an external reader. In the case of an electrical energy source, there is a choice of galvanic, capacitive or inductive transmission of electrical energy. In the case of an external energy source, the security document may be brought, for example, into a corresponding local electric or magnetic or electromagnetic field, in order thus to enable energy to be transmitted capacitively and/or inductively, in particular wirelessly. An example of this is a mobile device such as, e.g., a smartphone, having a so-called NFC device (NFC=Near Field Communication).

It is preferred that a first optical security feature of the security element be provided by a light pattern that is shown by the mask layer as a result of the latter differentially transmitting the light emitted by the at least one luminous layer when the security element is viewed from the viewing side.

When the luminous layer is in the active state, i.e. when the luminous layer is providing or emitting light, a viewer viewing the security element from its viewing side perceives the light pattern in the region of the mask layer, the light pattern being constituted by the darker, opaque regions and lighter, transparent openings. Since such a light pattern is also clearly visible in unfavorable light conditions, such a security element provides a reliable and easily checked security feature that offers protection against falsifications, e.g. of banknotes or ID cards or commercial products. With an appropriate design of the luminous and/or mask to layer, which of the transparent openings in the mask layer the light then passes through to reach the eye of the viewer depends on the viewing angle at which the viewer views the security element. The design of the light pattern is thus dependent on the viewing angle.

According to a preferred design of the invention, the at least one opaque region of the at least one mask layer provides a second optical security feature of the security element, when the security element is viewed from the viewing side. The protection against falsification of the security document is thus not delimited solely by the light effects of the luminous and mask layers, but extended by a further security feature that exists independently of the light effects of the luminous and mask layers.

Preferably, the opaque region has an OVD and/or a printed layer (OVD=Optically Variable Device). Standard OVDs are holograms, in particular reflection holograms, Kinegram®, volume holograms, thin-film interference filters, diffractive structures such as, e.g., blazed structures, linear gratings, cross gratings, hexagonal gratings, asymmetrical or symmetrical grating structures, zero-order diffraction structures, moth-eye structures or anisotropic or isotropic matt structures, and optically variable printing colors or inks, so-called OVI® (OVI=Optically Variable Inks), which mostly contain optically variable pigments and/or dyes, liquid crystal layers, in particular on a dark background, photonic crystals, in particular on a dark background, etc.

In this case, it is possible for the at least two transparent openings to be realized as a metal-free region of the OVD, or as an unprinted region in the printed layer. The printed layer may be, e.g., a part of the printed image of a banknote. In particular, the printed layer may be applied by means of intaglio printing. The advantage of this technique is that, owing to the very high resolution, of several thousand DPI (DPI=Dots Per Inch), the transparent openings in the mask layer can be made very small. Therefore, the distance between two transparent openings can also be very small. Furthermore, conventional printing methods can to be used for value and security documents. In particular, indirect relief printing (so-called letterset) offers a high resolution and lower costs for the printing form than the intaglio printing method.

It is particularly advantageous to use, as mask layer of such a self-luminous or backlit security element, an optical device that provides an autonomous optical security feature that also operates independently of the luminous layer, e.g. a printed security image having translucent windows, or an OVD, the metallic reflection layer of which serves as an opaque region of the mask, and which additionally has transparent regions, through which light from the luminous layer can pass out of the security element. The interaction of the self-luminous or backlit luminous layer and the optical device, serving as mask layer, results, synergistically, in a multiple optical effect: on the one hand, the optical security element operates as such—irrespective of whether the luminous layer is emitting or providing light; on the other hand, the security element exhibits the particular optical effects already discussed above, that can be created through the interaction of a self-luminous or backlit luminous layer and a mask layer that covers the luminous layer. In particular, the optical effect of the optical security element is virtually perfectly visible if the proportion of the area of the transparent openings in the mask layer is small. For example, the proportion of the area is less than 30%, and preferably less than 10%. Such a small area proportion is additionally advantageous for the image quality of the optical effects that result from the interaction with the self-luminous or backlit luminous layer. On the other hand, the brightness of the effect decreases as the proportion of the area of the transparent openings is reduced. A further disadvantage for the special configuration of the self-luminous luminous layer as a display (in particular, as a matrix display) is that, in the case of such small transparent area proportions, the part of the display that is overlaid by the mask layer is scarcely usable, or cannot be used at all, for the representation of information.

For the configuration that comprises a mask layer composed of metal (e.g. Al) and that has additional optical security features such as diffractive structures, it is to possible for the transparent openings to be produced, not by demetallization, but by the provision of suitable structures in the region of the transparent openings. These suitable structures must increase the transmission of the metal mask layer by at least 20%, preferably by at least 90%, and more preferably by at least 200% in comparison with the regions around the transparent openings. Examples for the suitable structures are so-called sub-wavelength gratings having periods of under 450 nm, preferably of under 400 nm, and depths of greater than 100 nm, preferably of greater than 200 nm. Such structures for setting the transparency of a metal layer are described in WO 2006/024478 A2. Alternatively, these suitable structures may be random structures having a mean structure size of under 450 nm, preferably of under 400 nm, and depths of greater than 100 nm, preferably of greater than 200 nm. The advantage of this variant is that there is no need for demetallization; the disadvantage is that the transmission in the region of the transparent openings is less than in the case of demetallized openings.

Preferably, the mask layer and, in particular, the transparent openings in the mask layer are spaced apart from the luminous layer, at a distance h from each other, as viewed perpendicularly in relation to a plane spanned by the viewing side or back side of the security element. Since the mask layer and the luminous layer do not directly adjoin each other, the region of the luminous layer that is visible through the transparent openings in the mask layer changes as the security element is tilted. This makes it possible to achieve interesting, optically variable effects, as also explained further below. Preferably, the distance h is between 2 μm and 500 μm, more preferably between 10 μm and 100 μm, and yet more preferably between 25 μm and 100 μm.

According to a preferred development of the invention, light that exits the security element, through the mask layer, at differing emergence angles provides respectively differing items of optical information. A viewer, when tilting the security element, i.e. changing the viewing position and/or tilting the security element, e.g. horizontally to the left/right or vertically upwards/downwards, thus perceives differing items of optical information, e.g. light patterns. Differing views at differing viewing angles, i.e. a characteristic "image changeover", constitute a very simple, rapid and, at the same time, effective possibility for verifying the genuineness of a security document.

It is possible for the at least one luminous layer to have a luminous element that is luminous over its whole area or provides light over its whole area. In addition, however, it is advantageous for the luminous layer to have one or more first zones, in which the luminous layer can emit or provide light, and which are each preferably surrounded by a second zone or separated from each other by a second zone in which the luminous layer cannot emit or provide light. Thus, for example, one or more first zones that radiate light or provide light are realized in front of a background, constituted by a second zone, that does not radiate light or provide light.

Preferably, in this case, the luminous layer has two or more second zones.

For the purpose of realizing the one or more first zones, the luminous layer preferably has one or more separate luminous elements or transparent openings. With backlighting of the luminous layer, the transparent openings act like self-luminous luminous elements. In this case, the two or more separate luminous elements each have a radiating region, in which the respective luminous element can emit or provide light, and each of which constitutes one of the first zones. The one or more separate luminous elements are each preferably a self-luminous display element or a luminescent display element, or backlit openings.

According to a preferred embodiment, the luminous layer has a mask layer that is not provided in the region of the first zone, or first zones, and that is provided in the region of the second zone, or second zones. The mask layer prevents light from being emitted or provided by the luminous layer in the region of the second zone or second zones, in that it block, or at least substantially weakens, the light emitted or provided by the luminous layer in the second zone or second zones. In the region of the second zone, the mask layer preferably has a transmittance of at most 20%, more preferably of at most 10%, and yet more preferably of at most 5%, and is preferably composed of a metallic layer, preferably an opaque metallic layer. Between this mask layer and the back side of the security element, the luminous layer preferably has a full-area luminous element, or one or more luminous elements, in particular self-luminous display elements or luminescent display elements. In addition, however, it is also possible for the luminous layer to be a layer by which light that is incident on the back side is conducted to the mask layer, and by which incident light from the back side is thus provided in the region of the first zones and blocked in the region of the second zones.

Moreover, it is also possible for the luminous layer to have one or more, preferably two or more, second zones, in which the luminous layer cannot emit or provide light, and which are each preferably surrounded, or separated from each other, by a first zone. The luminous layer thus provides one or more second zones, in which the luminous layer does not radiate light, or cannot provide light, and which are surrounded by a background in which the luminous layer can radiate or provide light, for example two or more non-luminous second zones that are surrounded by a luminous background.

Preferably, one or more of the first zones, preferably all of the first zones, have at least one lateral dimension of less than 300 μm, more preferably of less than 100 μm, and yet more preferably of less than 50 μm. A lateral dimension in this case is understood to mean a dimension in the plane spanned by the viewing side or back side of the security element, i.e., for example, the width or length of the radiating region of a separate luminous element.

According to a preferred embodiment, the at least one mask layer has two or more transparent openings, which are arranged according to a second grid. In addition, the at least one luminous layer has two or more first zones, in which the luminous layer can emit or provide light, and which are arranged according to a first grid. Alternatively, it is also possible for the luminous layer to have two or more second zones, in which the luminous layer cannot emit or provide light, and for the two or more second zones to be arranged according to the first grid. As already stated above, in this case the two or more first zones, or two or more second zones, are each preferably separated from each other, or surrounded, by a first zone or second zone, respectively.

According to a first preferred embodiment, in this case the two or more transparent openings of the second grid may each be configured in the form of a micro-image or an inverted micro-image, in particular configured in the form of a motif, symbol, one or more numbers, one or more letters and/or a micro-text. Specific examples are denominations of banknotes and the year of issue of passports or ID cards. In this case, the two or more first zones or the two or more second zones are preferably configured in the form of a sequence of strips or pixels, as viewed perpendicularly in relation to a plane spanned by the viewing side or the back side of the security element. It is thus possible, for example, for the luminous layer to have two or more luminous elements, the radiating regions of which are each shaped in the form of a strip, rectangle or conic section, and which thus realize a corresponding sequence of one or more first zones having the shape, for example, of a one-dimensional line grid or of a two-dimensional dot grid or pixel grid.

In addition, however, it is also possible for the two or more first zones or the two or more second zones each to be configured in the form of a micro-image, as viewed perpendicularly in relation to a plane spanned by the viewing side or back side of the security element, in particular configured in the form of a motif, symbol, one or more numbers, one or more letters and/or a micro-text. In this case, the two or more transparent openings of the second grid preferably have the shape of a strip, rectangle or conic section.

In this way, interesting, optically variable effects can be generated. It is thus possible, for example, for the grid widths of the first grid and of the second grid to be selected such that they are not equal for adjacent first zones and transparent openings, or second zones and transparent openings, respectively, and to be selected such that these grid widths differ from each other by less than 10%, and preferably differ from each other by not more than 2%. Alternatively, it is also possible for the first grid and the second grid to be arranged with an angular offset of between 0.5° and 25° relative to each other, but for the grid widths of the first grid and second grid to be left equal in this case, or to be selected such that, as stated above, this differs, in respect of adjacent first zones and transparent openings, or in respect of adjacent second zones and transparent openings, by not more than 10%, preferably by not more than 2%.

It has been found that, with the grids aligned and realized in such a manner, it is possible to generate optically variable magnification, distortion and movement effects that provide interesting security features.

The first grid and/or the second grid in this case may be constituted by a one-dimensional or two-dimensional grid, wherein the grid width of the first grid and of the second grid in at least one spatial direction is preferably selected so as to be less than 300 μm, in particular less than 80 μm, and more preferably less than 50 μm. Preferably in this case, the two or more first zones or the two or more second zones of the first grid, and the transparent openings of the second grid, are arranged in relation to each other such that they overlap, at least in regions, as viewed perpendicularly in relation to a plane spanned by the viewing side or back side of the security element. If the grids are arranged and realized in such a manner, the optical effects generated by the individual openings, or first zones, become intermingled for the viewer, thereby enabling interesting, optically variable effects to be generated.

Moreover, it is possible for the first grid to be a periodic grid having a first period $p_1$ as grid width, and/or for the second grid to be a periodic grid having a second period $p_2$ as grid width.

It is thus possible for the at least one luminous layer to have two or more separate luminous elements that are arranged in a first periodic grid having a first period, and for the at least one mask layer to have two or more transparent openings that are arranged in a second periodic grid having a second period, wherein the first and the second period are not equal, but similar. This design of the invention is based on a moiré magnification effect (moiré magnifier), which is also known by the terms "shape moiré" and "band moiré". In this case, the size of the resultant moiré image depends on the extent to which the periods of the two grids differ from each other. Preferred image sizes are between 5 mm and 1.5 cm of the smallest dimension, for which the grid periods differ from each other, in particular, by not more than 10%, preferably differ from each other by not more than 2%. The opaque regions of the mask layer may be realized as metallic regions, e.g. as a metal layer of a metallized foil, or as a printed layer. Consequently, the transparent openings may be realized as demetallized regions of a metal layer, e.g. of a metallized foil, or as unprinted or thinly printed regions of a printed layer, or as regions of a printed layer printed with a transparent printing color. The transparent openings preferably realize so-called "micro-images", i.e. images that are preferably not resolvable by the unaided eye, which are magnified by the optical interaction with the luminous elements. Alternatively, the mask layer may also be an inverted mask layer. This means that, in this case, the "micro-images" are opaque and the background of the "micro-images" is transparent. The term "images" in this case includes all possible items of information, such as alphanumeric characters, letters, logos, symbols, outlines, pictorial representations, emblems, patterns, grids, etc.

If the area proportion of the transparent openings of the mask layer is large, for example greater than 50%, and preferably greater than 70%, the part of the display that is covered by the mask layer may nevertheless be used for the representation of information by the display. If the optional intermediate layer is present, the latter, for this case, must likewise have a high transmission, for example greater than 50% and preferably greater than 70%. In this embodiment, it is useful if, in the region covered by the mask layer, the display constitutes an image sequence, wherein this sequence alternates between the representation of the information of the display—for example, the face of the owner of an ID card—and the pattern that interacts with the mask layer.

If the luminous layer is inactive, i.e. is not emitting light, or not providing light, the "micro-images" are not visible, or at least not clearly visible, as magnified images. If the luminous layer is active, i.e. is emitting light, or providing light, the "micro-images" are clearly visible as magnified images. These magnified images alter, move or tilt over vertically if the security element is tilted to the left or right, or upwards or downwards, or if it is viewed from differing perspectives. In comparison with known moiré magnification arrangements, there is a difference in that the latter are always visible, whereas, in the case of the present development of the invention, the "micro-images" are only clearly visible as magnified images if the luminous layer is active, or providing light. Thus, a further optical effect can be generated by "switching" the luminous layer between on and off, or between backlit and non-backlit.

Apart from embodiments in which the first grid and the second grid are periodic grids, and the micro-images are identical micro-images, it has also been found, moreover, that advantageous movement and morphing effects, generated upon tilting or turning, can be achieved by the following designs: to achieve such effects, it is proposed to continuously vary the grid width of the first and/or second grid, and or the angular offset of the first and the second grid relative to each other, and/or the shape of the micro-images, according to a parameter variation function, in at least one spatial direction. By altering the grid width of the first and/or second grid, and/or altering the angular offset of the first and the second grid in relation to each other, it is thus possible, for example, to vary the magnification (see statements above) and, for example, the direction of movement of the representation that results for the viewer upon tilting. The alteration of the shape of the micro-images according to the parameter variation function makes it possible to generate, for example, transformation effects and complex movement effects in combination with the latter.

Moreover, it is also possible for the grid width of the first and/or second grid, and/or the angular offset of the first and the second grid relative to each other, and/or the alignment of the first grid and/or the second grid, and/or the shape of the micro-images in a first region of the security element to differ from the corresponding parameters in a second region of the security element. In this way, also, the generation of complex, optically variable effects can be further improved, and consequently the optical appearance and security against falsification of the security element can be further improved.

According to a further preferred embodiment example, the transparent openings in the second grid and/or the two or more first zones and/or the two or more second zones of the first grid are each varied in their surface area, for the purpose of generating a half-tone image. It is thus possible, for example, for the transparent openings in the second grid or the two or more first zones or the two or more second zones of the first grid each to be in the shape of a strip, and for the width of the strip-shaped opening, or strip-shaped first or second zones, to be varied locally for the purpose of generating a half-tone image. It is thereby possible, for example, for the corresponding half-tone image to be visible, for example by reflected light, to the viewer when viewing the front or back side of the security element in a state in which no light is being provided or emitted by the luminous layer, and for the security feature described above, generated by the interaction of the mask layer and the luminous layer, to be visible in a state in which the luminous layer is providing or emitting light. It is also possible in this case for a first such half-tone image to be visible when viewed from the front side (by reflected light) a second half-tone image, different from the first, to be visible when viewed from the back side (by reflected light), and for the security feature described by the combined action of the luminous layer and the mask layer, to become visible when viewed from the viewing side, in a state in which the luminous layer is providing light or emitting light. Thus, in this case, for example, the first half-tone image is provided by the variation of the transparent openings of the second grid, as described above, and the second half-tone image is provided by the corresponding variation of the first zones or the second zones of the first grid.

Moreover, through correspondingly differential coloring of the mask layer in the opaque regions arranged between the transparent openings of the second grid, it is also possible, in addition, to generate a colored image that is preferably only visible when the luminous layer is not providing or emitting light, when viewed from the viewing side. Furthermore, in this case, such a multicolored image can also be varied locally in its color brightness, by means of the variation, described above, of the transparent openings of the second grid.

It is possible for the at least one mask layer to have at least two arrangements of transparent openings, wherein light emitted by the at least one luminous layer exits the security element through the at least two arrangements at respectively differing emergence angles. An arrangement of transparent openings comprises one or more openings. At least two arrangements of transparent openings thus comprise at least two differing openings that differ from each other in their arrangement, i.e. position, in the mask layer, and possibly also in their shape. Upon tilting the security element, a viewer thus perceives differing items of optical information, e.g. light patterns: if light reaches his eye through openings of a first arrangement, he sees a first item of optical information. If light reaches his eye through openings of a second arrangement, at a different viewing angle, he sees a second item of optical information. Differing views at differing viewing angles, i.e. a characteristic "image changeover", constitute a very simple, rapid and, at the same time, effective possibility for verifying the genuineness of a security document. A simple example is a changeover of image between the denomination number of a banknote, e.g. "50" and a national emblem, e.g. the "Swiss cross".

It is possible for the light exiting the security element through the at least two arrangements, at respectively differing emergence angles, to realize an image sequence consisting of two or more images, wherein each of these images is present at a different emergence angle. Very striking optical information can be conveyed, in the manner of a film, by means of an image sequence showing, e.g., a galloping horse. Moving images in combination with self-luminous switchable luminous elements, or elements providing light, possibly even emitting or providing colored light, produce a surprising optical effect on security documents, which offers an effective and easily striking possibility for verifying the genuineness of a security document.

It is preferred that the at least one luminous layer has two or more separate luminous elements, arranged in a pattern, and that the transparent openings of the at least two arrangements are realized so as to match this pattern. In this case, at least one opening is assigned, respectively, to every luminous element contributing to the optical effect, through which opening light, emitted by the luminous element, exits the security element at an assigned emergence angle in each case. As a result of matching the luminous elements to the openings, a combined action of differing openings of an arrangement can be achieved. At a particular viewing angle, therefore, light reaches a viewer, not merely through one transparent opening, but through a multiplicity of transparent openings. This, in turn, through skilful arrangement and spatial distribution of the openings, opens up the possibility of realizing gridded images, in the form of a digital raster graphic, the pixels of which, i.e. image elements, are constituted by the individual openings. In the case of a typical arrangement for realizing an image changeover, two openings in the mask layer are arranged symmetrically at a layer distance h above an assigned luminous element of the luminous layer.

It is preferred that the at least one luminous layer and the at least one mask layer are arranged parallel to each other. In this case, it is easier to maintain a mutual register accuracy than when the at least one luminous layer and the at least one mask layer converge at an acute angle.

It is possible for at least one opaque intermediate layer, having at least one arrangement of translucent openings, to be arranged, at least partially, between the at least one luminous layer and the at least one mask layer. "Crosstalk", in connection with the security element, is understood to mean the phenomenon whereby light of a second luminous element reaches the viewer through transparent openings in the mask layer that are assigned to a first luminous element, i.e. an unwanted transmission of light through a transparent opening in the mask layer. This problem arises particularly when the distance between the luminous layer and the mask layer is relatively large. If an intermediate layer is is then inserted between the luminous layer and the mask layer, the translucent openings in the intermediate layer act, as it were, as a second luminous layer, but with a reduced distance in relation to the mask layer. As a result of the reduction in distance, the problem of "crosstalk" can be reduced or prevented.

A further advantage of an intermediate layer consists in that a luminous layer that radiates or provides light over its whole surface, e.g. a large-area LED or a transparent, backlit foil that scatters diffusely, can easily be converted into a grid of separate luminous elements, i.e. pixels (LED=Light-Emitting Diode).

Preferably, the intermediate layer is closely matched to the mask layer, e.g. in a common production process, and used jointly, in the form of a layer composite/laminate, to produce the security element. In this case, the arrangement of the translucent openings in the intermediate layer can be matched to the luminous layer, or be independent of the latter. Such an intermediate layer can, for example, be produced in exact register with the mask layer, in that both layers are effected by printing the front side and back side of a foil. It is also conceivable, in a production process, to use an image recognition system that evaluates the optical effect with backlighting or with the luminous layer switched on, to control the operation of arranging the mask layer and intermediate layer, or luminous layer, with precision in respect of their angle and/or position in relation to each other.

Arrangement of two layers in exact register with each other is understood here to mean an arrangement whereby the two layers are matched to each other, particularly in the form of a positionally exact arrangement of the two layers in relation to each other. In particular, such an arrangement of two layers in relation to each other can be achieved in that, as one layer is applied, the exact position of the other layer is acquired, for example by means of register marks, and the position of this other layer, in particular its position in a plane spanned by the front side or back side of the security element or security document, is taken into account as the layer is applied. This makes it possible, in particular, for openings in the layer to be arranged with exact positioning in relation to each other, in particular to overlap, when viewed in a spanned plane perpendicular to the front side or back side of the security element or security document.

It is possible for light-scattering or luminescent elements to be arranged in the translucent openings in the intermediate layer, which elements scatter incident light from the luminous layer in the direction of the mask layer, or re-radiate it by luminescence. The light-scattering elements may be composed, e.g., of matt, transparent materials, which effect diffuse scattering of incident light. The luminescent elements may be fluorescent and/or phosphorescent materials, which absorb incident light and re-radiate it in the same or a different wavelength range, immediately and/or in a time-staggered manner. Excitation of such luminescent elements may not only be effected by a luminous layer located at the back, as viewed from the viewing side. Alternatively, it is also conceivable for the luminescent elements to be excited from the viewing side, i.e. through the mask layer.

It is possible for the at least one luminous layer to have two or more separate luminous elements, wherein these luminous elements and the at least one transparent opening in the mask layer have a rectangular shape, as viewed perpendicularly in relation to the plane of the foil body. Preferably, this rectangular shape is a rectangle having a length m and a width n, wherein the ratio m/n is greater than or equal to 2. Moreover, it is advantageous if the outline of the luminous elements is identical to that of the openings; then, when the security element is tilted about the longitudinal axis of the luminous elements, or openings, the light of the luminous element completely fills the associated opening in. The mask layer, without leaving unilluminated sub-regions. As an alternative to this, the transparent opening in the mask layer may have a square or circular shape, having, respectively, the edge length or diameter m, as viewed perpendicularly in relation to the plane of the foil body. Here, likewise, it is advantageous if the outline of the luminous elements is identical to that of the openings.

It is possible for the at least one luminous layer to have two or more separate luminous elements, wherein the space between adjacent luminous elements is considerably greater than the width of the luminous elements. Preferably, a distance between adjacent luminous elements is approximately 5 times greater, preferably approximately 10 times greater, than the width of the luminous elements. In this case, it is possible for openings in the mask layer to be unambiguously assigned to a single luminous element of the luminous layer.

It is possible for the at least one luminous layer to have two or more luminous elements that emit light in at least two differing colors. The use of differing light colors makes additional striking optical effects possible, in addition to a light-dark light pattern defined by the mask layer. Thus, for example, in addition to perceiving an image changeover, a viewer can also perceive differing colors at different viewing angles. If a matrix of individual luminous elements is used, the elements being controllable, in the manner of pixels, as individual image elements, preferably in a manner similar to pixels in image sensors and display screens, in the form of areas that are each of a primary color (RGB=Red, Green and Blue), differing colored images can be generated, according to the control of the luminous elements. For example, with such a luminous layer, with a suitable mask layer, it would be possible to achieve an image changeover from a true-color image to a false-color image. For such color changeovers, it is important that the mask layer is not only aligned in register with the pixels of the display, but that, in addition, the openings in the mask layer are also aligned to the correct color pixels.

The security element is preferably a security element for the identification marking of a security document and increasing the security against falsification of the latter, in particular of a banknote, monetary instrument, check, taxation revenue stamp, postage stamp, visa, motor vehicle document, ticket or paper document, or of identification documents (ID documents), in particular a passport or ID card, identity card, driving license, bank card, credit card, access control pass, health insurance card, or of a commercial product, for the purpose of increasing the security against falsification and/or for the purpose of authentication and/or traceability (track & trace) of the commercial product or any chip cards and adhesive labels.

According to a preferred development of the invention, the security document has a maximum thickness of 2000 μm, and preferably a maximum of 1000 μm, and yet more preferably a maximum of 500 μm. In this case, the total thickness of the security document and the security element arranged thereon, is particularly suited to practical application. According to ISO 7810, ID1 cards have, for example, a thickness of 0.762 mm (exactly 0.03 inches), with a tolerance of ±0.08 mm. Limitation of the total thickness is especially important in the case of security documents subjected to mechanical handling, such as, e.g., banknotes in automated cash dispensers, or cash counting and sorting machines, as well as ID cards in standard readers. In such cases, an excessive total thickness of the security document would impair its handling. In particular for banknotes, it is particularly preferred if the security document has a thickness in the range of from 20 to 200 μm, and further of from 50 to 200 μm, in this case preferably in the range of from 50 to 140 μm, and further of from 85 to 140 μm, in particular of approximately 100 μm.

The at least one security element in this case may be realized in the form of a stripe or in the form of a label on the security document, or be arranged as a stripe or as a label within a, in particular, regionally transparent layer laminate.

Moreover, it is advantageous if, following application of the at least one security element, the security document is printed with at least one opaque printing color to and/or at least one opaque colored varnish. In one embodiment, only regions of the security element are covered with this.

In this case, the stiffness of the composite, composed of the security document and security element, in the region of a piezoelectric energy source is to be set is such that the impressed force, and the mechanical stress caused thereby, is distributed to further regions of the energy source, in particular to the entire region of the energy source, in order to generate a sufficiently high voltage for switching the luminous layer when the layer of piezoelectric material is bent. The stiffness can generally be influenced and imparted to the required region, before or after application of the security element to the security document, by selective regional application of opaque printing color and/or of an opaque colored varnish, and/or by application of other layers, including those that are transparent over their full surface area.

The at least one security element in this case can be arranged on or embedded in the security document. The at least one security element is preferably applied to a surface of the security document by stamping, with a transfer foil or laminating foil being used. Insertion within the security document is preferably effected already during the production of the security document. Thus, in the case of a security document made of paper, the at least one security element can be inserted in the paper already during the paper production. In the case of banknotes, the security element may also be generated only at the time of being integrated into the banknote. For example, this may be effected by hot-stamping a KINEGRAM® patch with a demetallization in the arrangement of the transparent openings in the mask layer, wherein an intaglio imprint is applied with an exact angular fit on the other side of the banknote. This imprint has transparent openings in the region of the security element, which act in combination with the transparent openings in the mask layer opposite to generate the desired optical effect when viewed with back lighting. In the case of ID documents, the security element can be laminated into a layer composite of the security document or applied to the surface of the security document.

Moreover, it is also possible for the security element as such to already constitute a security document, the latter being, for example, a banknote, a monetary instrument, a paper document, an identification card, in particular a passport or an ID or bank card. The security element in this case may be composed of various sub-elements that are laminated together during the production process. It is thus possible, for example, for the at least one mask layer to be constituted by a flexible, multilayer foil body that is applied as a laminating foil or transfer layer of a transfer foil to the luminous layer of the security element. Optionally, there may also additionally be transparent intermediate layers between the luminous layer and the multilayer foil body. Moreover, it is also possible for the masking layer and the luminous layer to be embedded between different layers of the security element.

BRIEF DESCRIPTION OF THE DRAWINGS

The invention is explained in the following on the basis of several embodiment examples and with the aid of the accompanying drawing. There are shown, schematically and not true to scale, in.

DETAILED DESCRIPTION OF THE INVENTION

Figure 1:
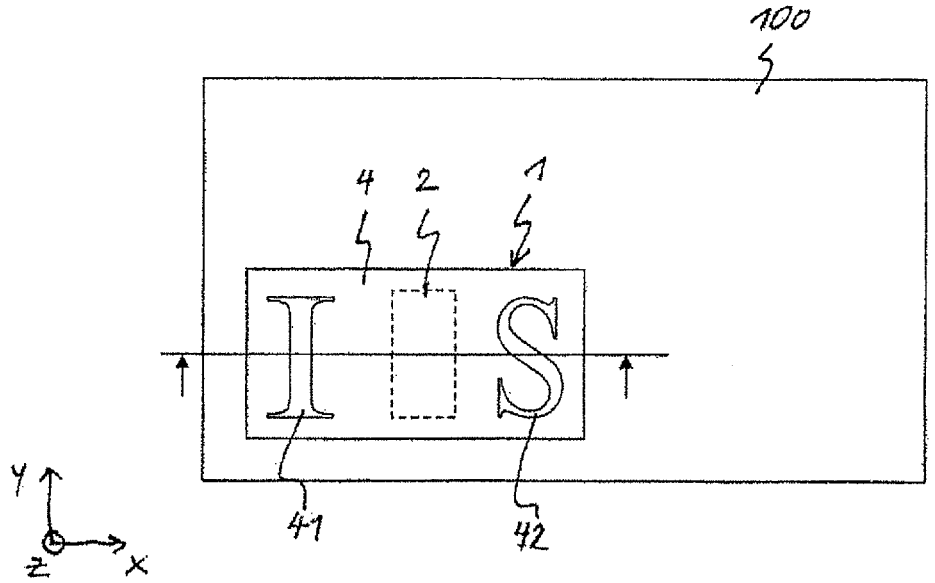
FIG. 1 a top view of a security document, having a security element arranged on one side of the security document.

FIG. 1 shows a security document 100, attached to the viewing side of which there is a security element 1, which is intended to make falsification of the security document 100 more difficult. The security element 1 comprises a mask layer 4 that has transparent openings 41, 42 in the form of capital letters "I" and "S", and a luminous layer 2 arranged between the mask layer 4 and the security document 100. The luminous layer has a rectangular outline, as viewed in the direction perpendicular to the xy plane, wherein the longer sides extend in the y direction.

Figure 2:
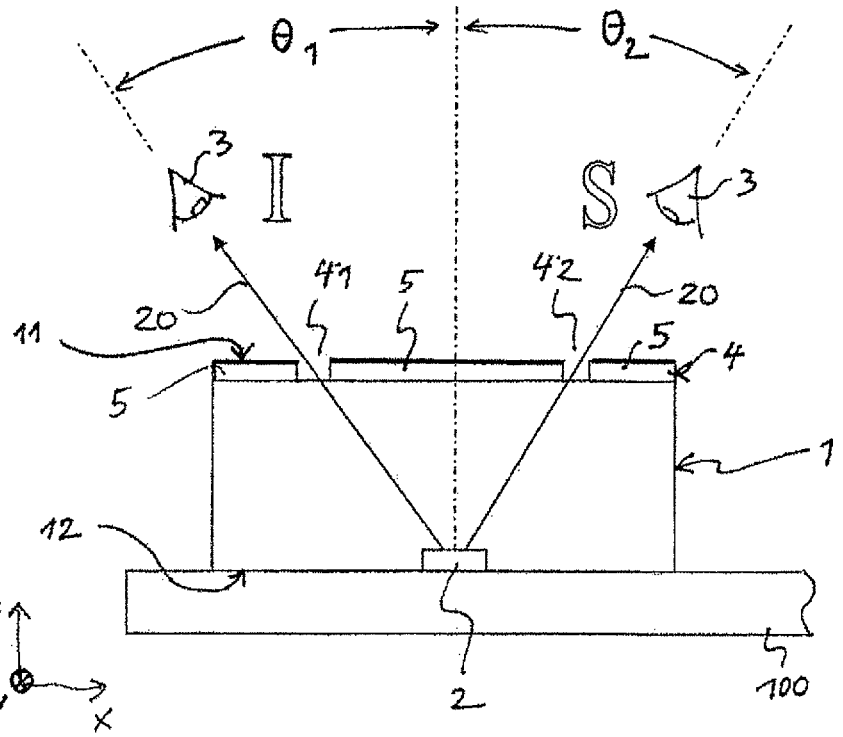
FIG. 2 a section of the security document from FIG. 1.

FIG. 2 shows a section through the security element 1, along the line II-II indicated in FIG. 1. The security element 1 is constituted by a flexible, multilayer foil body that is attached by its underside 12 to a side of the security document 100, e.g. affixed by means of an adhesive layer, and the viewing side 11 of which faces towards a viewer 3 of the security element 1. The foil body 1 comprises the luminous layer 2, which can generate and emit light 20, and the mask layer 4, which completely covers the luminous layer 2. Here, the luminous layer 2 and the mask layer 4 are spaced apart from each other by a distance h. The mask layer 4 comprises opaque regions 5 and transparent openings 41, 42. The viewer 3, viewing the security element 1 perpendicularly from above, cannot perceive light radiated by the luminous layer 2, since, in the perpendicular viewing direction, indicated by a dot-dash line in FIG. 2, this light is blocked by the central opaque region 5 of the mask layer.

The distance h in this case is the distance between the underside of the mask layer 4 and the top side of the luminous layer 2, in particular the first zones of the luminous layer, in which the latter radiates or provides light.

It is only when the viewer 3 swivels his viewing direction in the mathematically positive direction of rotation, by the angle $\theta_1$, about the y axis, i.e. to the left in the drawing, that light reaches him through the transparent openings 41 in the form of the capital letter "I". In this viewing direction $\theta_1$ the viewer 3 thus perceives the luminous capital letter "I". If the viewer 3 swivels his viewing direction in the mathematically negative direction of rotation by the angle $\theta_2$, about the y axis, i.e. to the right in the drawing, light reaches him through the transparent openings 42 in the form of the capital letter "S". The viewer 3 thus perceives the luminous capital letter "S".

Depending on the viewing direction, therefore, a viewer 3 perceives either no information, or a first item of information or a second item of information. This design of the invention thus offers the optical effect of the so-called "image flip".

Figure 3A:
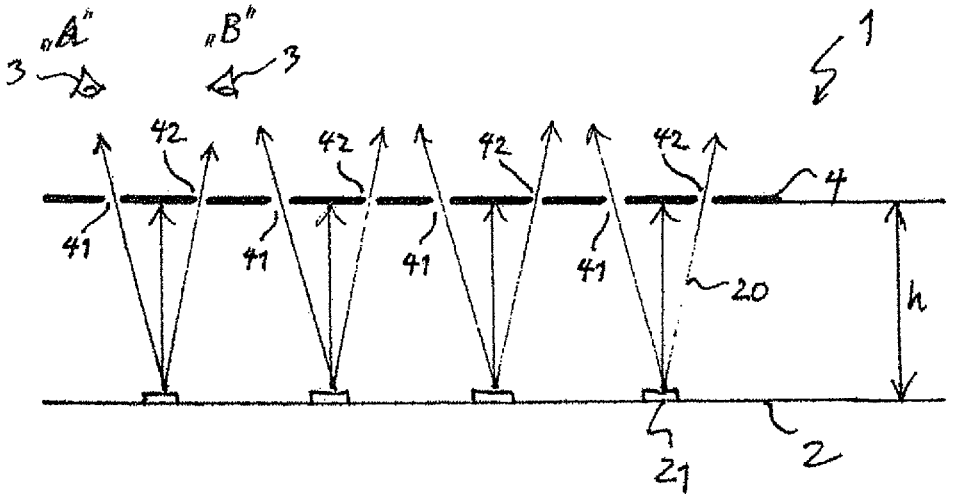
FIG. 3*a* a section of a security element.

FIG. 3*a* shows a section through a security element 1, which has a luminous layer 2 composed of a multiplicity of periodic luminous elements 21, and parallel thereto, at a distance h, a mask layer 4 that has two different arrangements 41 and 42 of holes. In this case, an opening of each of the two arrangements 41 and 42 is assigned, respectively, to each luminous element 21. The luminous elements 21 are, e.g., elongate LEDs, whose longitudinal axis is perpendicular to the plane of the drawing. The openings 41, 42 are likewise elongate openings having a rectangular outline, the longitudinal axis of which is parallel to that of the luminous elements 21.

Figure 3B:
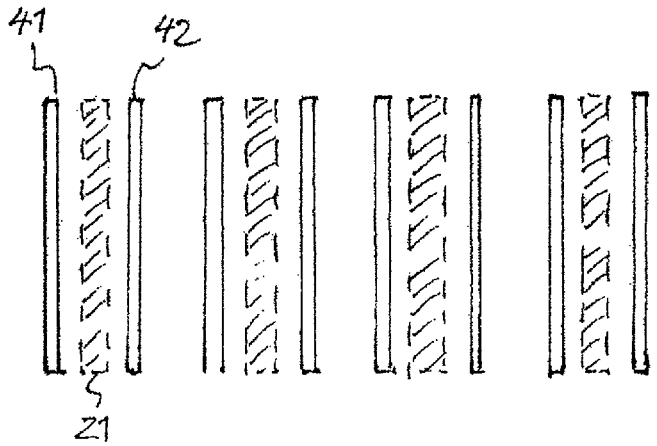
FIG. 3*b* a top view of the security element from FIG. 3*a;*

A top view of the viewing side of the security element 1 from FIG. 3*a* is shown in FIG. 3*b*, wherein the luminous elements 21 not visible through the mask layer 4 to are indicated by broken lines. An opening of the arrangement 41, 42 is in each case assigned, with a lateral offset, to a luminous element 21, with the result that a viewer 3 does not perceive any light when viewing the security element 1 perpendicularly in relation to the plane of the security element, but when viewing from a first angle, light reaches the eye of the viewer through the first arrangement 41 of the openings. If the viewing direction is turned round to the opposite direction, light reaches the viewer 3 through the second arrangement 42 of openings. For example, the first arrangement 41 of openings may be realized such that the light pattern indicates the capital letter A to the viewer 3, whereas light reaching the viewer 3 through the openings of the second arrangement 42 indicates the capital letter B to the viewer 3.

The transparent openings may be, for example, demetallized regions in a metallized security element having conventional optically variable effects in reflection, e.g. hologram, Kinegram® etc.

Figure 4:
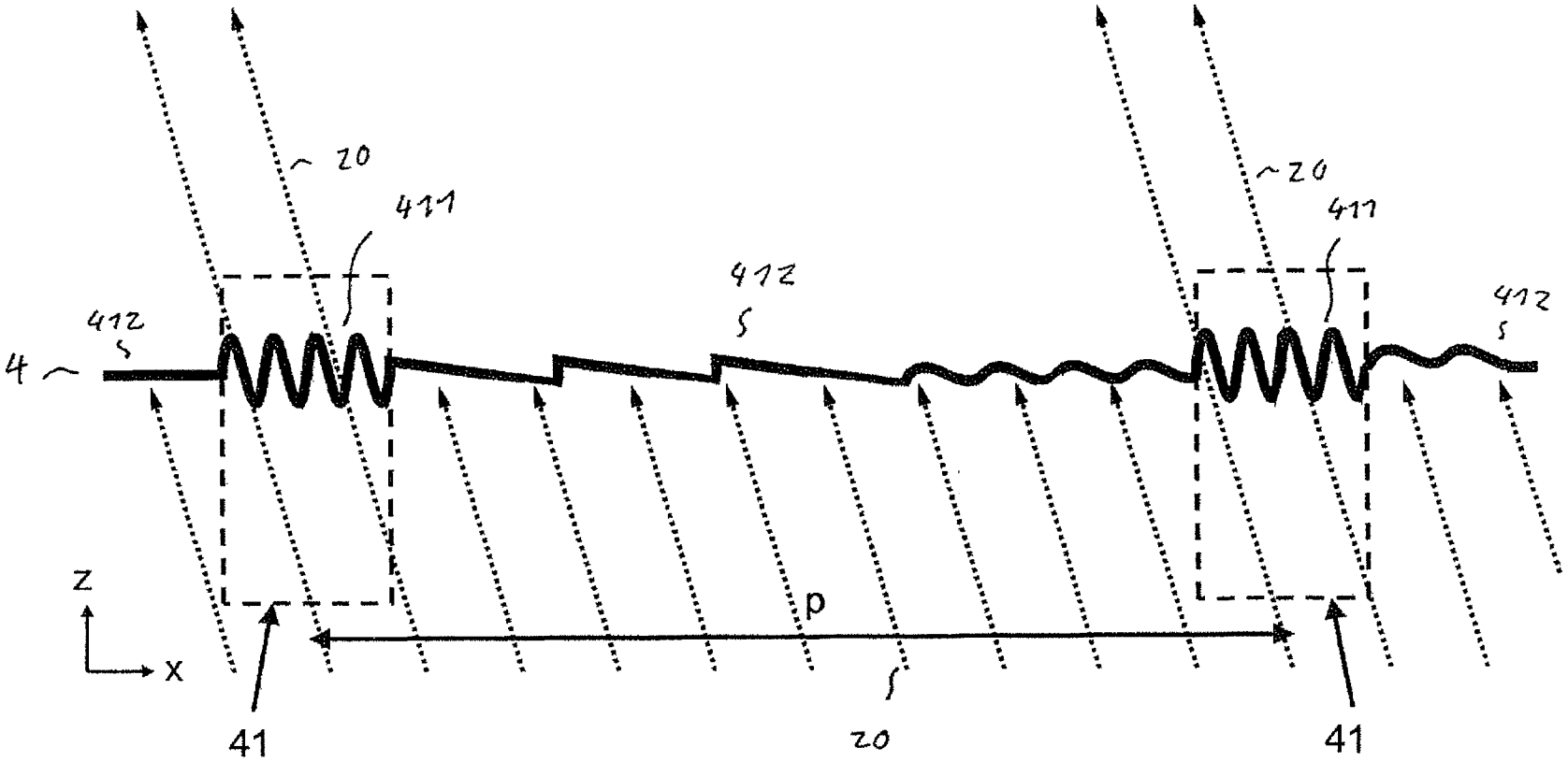
FIG. 4 a section of a security element.

The transparent openings may alternatively contain suitable structures that, even without demetallization, have a significantly higher transmission than structures designed for reflection. These suitable structures must increase the transmission of the metal mask layer by at least 20%, preferably by at least 90%, and more preferably by at least 200%, as compared with the regions around the transparent openings. Examples of the suitable structures are so-called sub-wavelength gratings having periods of under 450 nm, preferably of under 400 nm, and depths of greater than 100 nm, preferably of greater than 200 nm. FIG. 4 shows an exemplary schematic side view of a mask layer 4, which has relief structures 411, realized as sub-wavelength structures as described above, in the openings 41. The grid spacing, or period, of the transparent openings 41 is p. Between the openings 41, the mask layer 4 has relief structures 412 that in reflection generate optically variable effects but that, at the same time, do not increase, or increase only insignificantly, the transmission through the metal layer. By way of example, the relief structure 412 has sinusoidal gratings, mirror surfaces and/or blazed gratings, whose spatial frequency is preferably between 100 and 2000 lines/mm.

Figure 5:
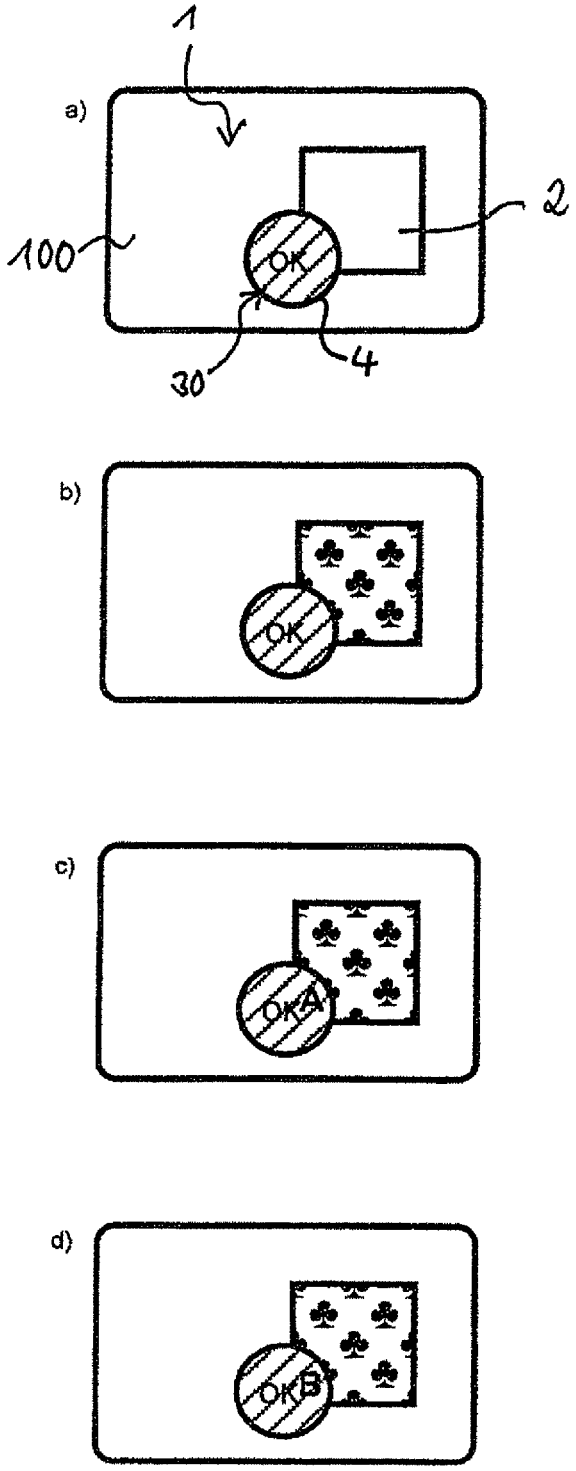
FIG. 5 optical effects of the security element from FIG. 3.

FIG. 5*a* shows a top view of the security element 1 from FIG. 3, when the luminous layer 2 is inactive, i.e. not emitting or providing light. In this case, the items of information that are present in the security element in the form of the openings in the mask layer 4 are not visible, being, as it were, "hidden". Only a conventional reflection hologram 30, which partially covers the luminous layer 2 and represents the letters "OK" as a security feature, is visible. A metallic reflection layer of the reflection hologram 30 serves as mask layer 4 of the security element 1.

FIGS. 5*b* to 5*d* show optical effects of the security element when the luminous layer 2 is active, i.e. is emitting or providing light. FIG. 5*b* shows the optical effect of the security element 1 when the plane of the security element 1 is viewed perpendicularly. In this case, i.e. when viewed perpendicularly, the light emitted by the luminous layer 2 towards the viewer is blocked off by opaque regions of the mask layer 4, with the result that the viewer does not perceive any light in the region of the mask layer 4. The viewer only perceives light in the region of the luminous layer 2 that is not covered by the mask layer 4. In addition, the reflection hologram 30, which partially covers the luminous layer 2, is visible.

FIGS. 5*c* and 5*d* show the optical effect of the security element 1 when the plane of the security element 1 is viewed obliquely. In these cases, the items of information that are present in the security element 1 in the form of the openings 41, 42 in the mask layer 4 are visible. In addition, the reflection hologram 30, which partially covers the luminous layer 2, is visible when suitably illuminated. FIG. 5*c* shows the optical effect of the security element 1 when it is viewed from the left: the letter "A" is visible. FIG. 5*d* shows the optical effect of the security element 1 when it is viewed from the right: the letter "B" is visible. Upon alteration of the viewing angle, differing items of information appear, in this example either. A or B, since in each case light beams are transmitted at differing emergence angles through the mask layer 4. This letter flip/image changeover is easily identifiable, even in very darkened rooms.

The colors in which the items of information appear are determined by the luminous layer 2, but may be varied by means of colored, fluorescent, phosphorescent and other layers that can cause variation in a light color and that are located between the luminous layer 2 and the viewer.

Figure 6:
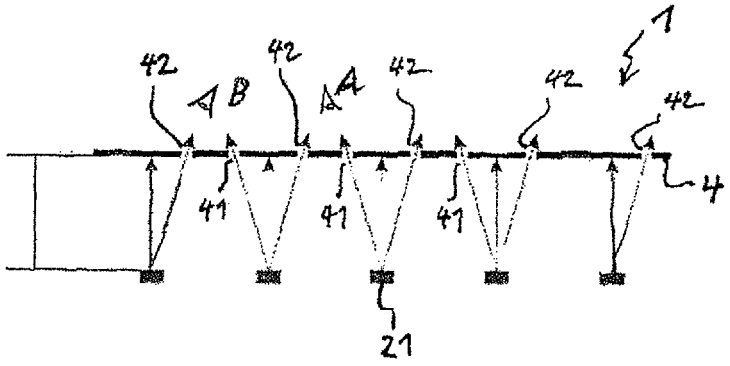
FIG. 6 a section of a further security element.
Figure 7:
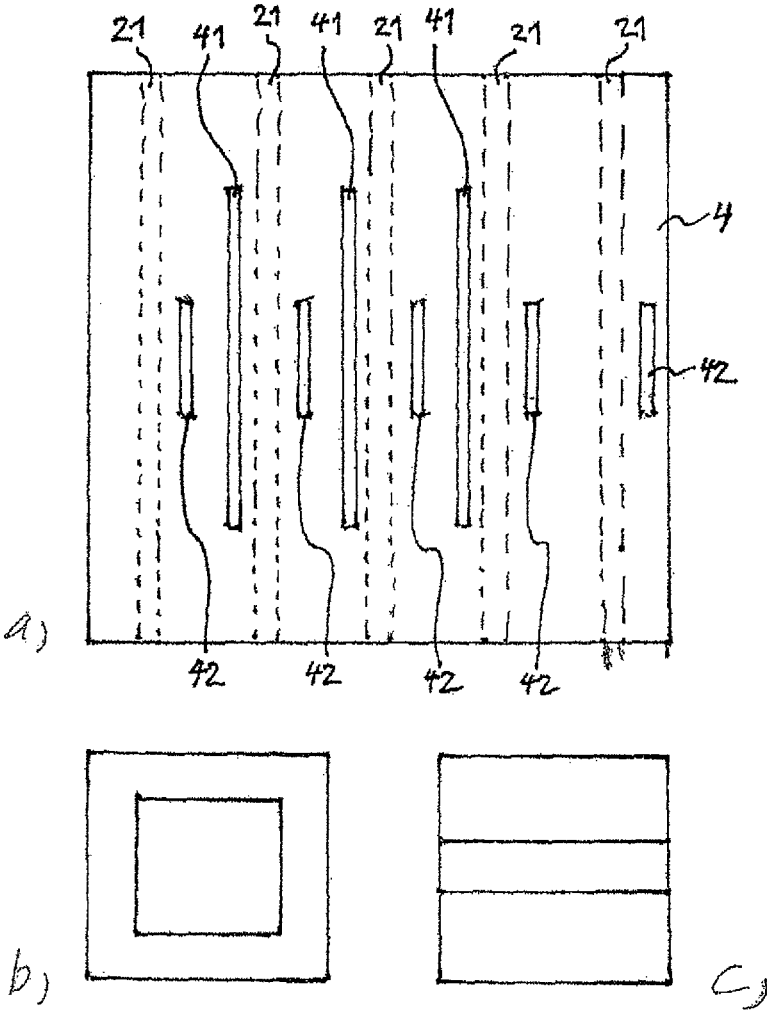
FIG. 7 a top view of the security element from FIG. 6, and optical effects that can be achieved with this security element.

FIG. 6 shows a section through a further security element 1. The section corresponds substantially to the section shown in FIG. 3, but the openings 41, 42 in FIG. 6 differ in length, as shown in FIG. 7. In the portion of the luminous element represented in FIG. 7*a*), the first arrangement 41 of openings comprises a total of three openings, which are arranged on the left side of the luminous elements 21. The second arrangement 42 of openings in this portion comprises a total of five short openings, which are each arranged on the right side of the luminous elements 21. If a viewer views the security element from a first angular position A, as represented in FIG. 6, a square, as shown in FIG. 7*b*, is revealed to him by the light reaching the viewer from the luminous element 21 through the long openings 41. If, on the other hand, the viewer is viewing from an angular position B, as shown in FIG. 6, then the light that reaches the eye of the viewer from the luminous elements 21 through the short openings 42 constitutes a continuous, narrow band, as shown in FIG. 7*c*. Upon alternating between the positions A and B, a viewer accordingly perceives an alternation between the two images 7*b* and 7*c*. This requires a phase shift of the openings of the second image in comparison with the openings of the first image. If the luminous elements 21 are realized multicolored, each of the two differing images can be represented in a separate color, e.g. as a green square and a yellow stripe. When viewing the security element 1 perpendicularly in relation to the plane of the security element 1, the viewer does not perceive any light from the luminous elements 21. In this case, the security element 1 appears dark to the viewer, or he perceives only a security feature that is placed on the opaque regions of the mask layer 4. It is obvious to a person skilled in the art that the images represented, i.e. the square and the continuous stripe, represent only two optional examples. Other possibilities for images are, e.g., texts, logos or images the resolution of which depends on the grid of the luminous elements 21 and openings 41, 42.

Figure 8:
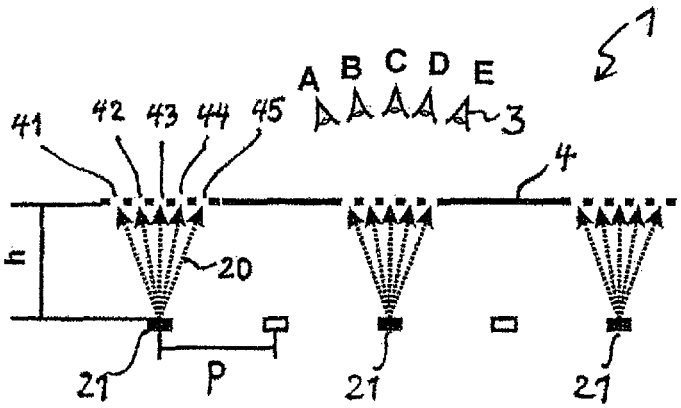
FIG. 8 a section of a security element for realizing an image sequence.

FIG. 8 shows a section through a security element 1, for realizing an image sequence. An image sequence is generated in a manner entirely similar to that of an image changeover: instead of a changeover between two images, A and B, a sequence of several images, A, B, C, D and E, is realized, these images being successively perceptible when the security element is tilted from left to right, i.e. as shown in FIG. 8, about the longitudinal axis of the luminous elements 21.

FIG. 8 shows a luminous layer 2, having separate luminous elements 21, arranged above which, at a vertical distance h, there is a mask layer 4 having five arrangements 41 to 45 of openings. An opening of each arrangement 41 to 45 is arranged, respectively, above a single luminous element 21, in a symmetrical arrangement. Since only each second luminous element 21 of the luminous layer 2 is activated, or provides light, adjacent active luminous elements 21 have a lateral spacing of 2×p, wherein, e.g., p=200 μm. The openings are each structured, i.e. realized so as to be either opaque or transparent, such that the totality of the openings of an arrangement 41 to 45 generates the desired luminous image. If the openings, as shown in FIG. 8, are structured in the form of capital letters A to E, a viewer 3, upon tilting the security element 1 from left to right, sees the light 20 of each luminous element 21 in succession, through each of the successive openings 41 to 45, wherein a differing luminous image is perceived by him at each viewing angle. If the viewer 3 tilts the security element 1 in the opposite direction, the images E to A appear to him successively, i.e. in the reverse sequence. The number of images that can be represented in such an image sequence, and the complexity of each individual image, are limited by the resolution of the mask layer 4 and the geometry of the combination of luminous layer 2 and mask layer 4.

Figure 9:
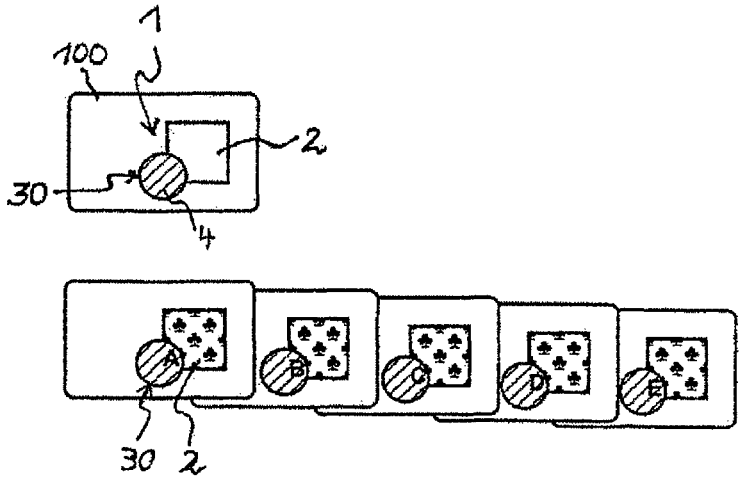
FIG. 9 optical effects of the security element from FIG. 8.

FIG. 9 shows a security document 100, on which a luminous layer 2 is partially covered by a reflection hologram 30, wherein a metallic reflection layer of the reflection hologram 30 serves simultaneously as mask layer 4 for the security element 1. The lower part of FIG. 9 shows the image sequence, as already indicated in FIG. 8, in a top view of the security document 100. A sequence of capital letters A to E is obtained.

Figure 10:
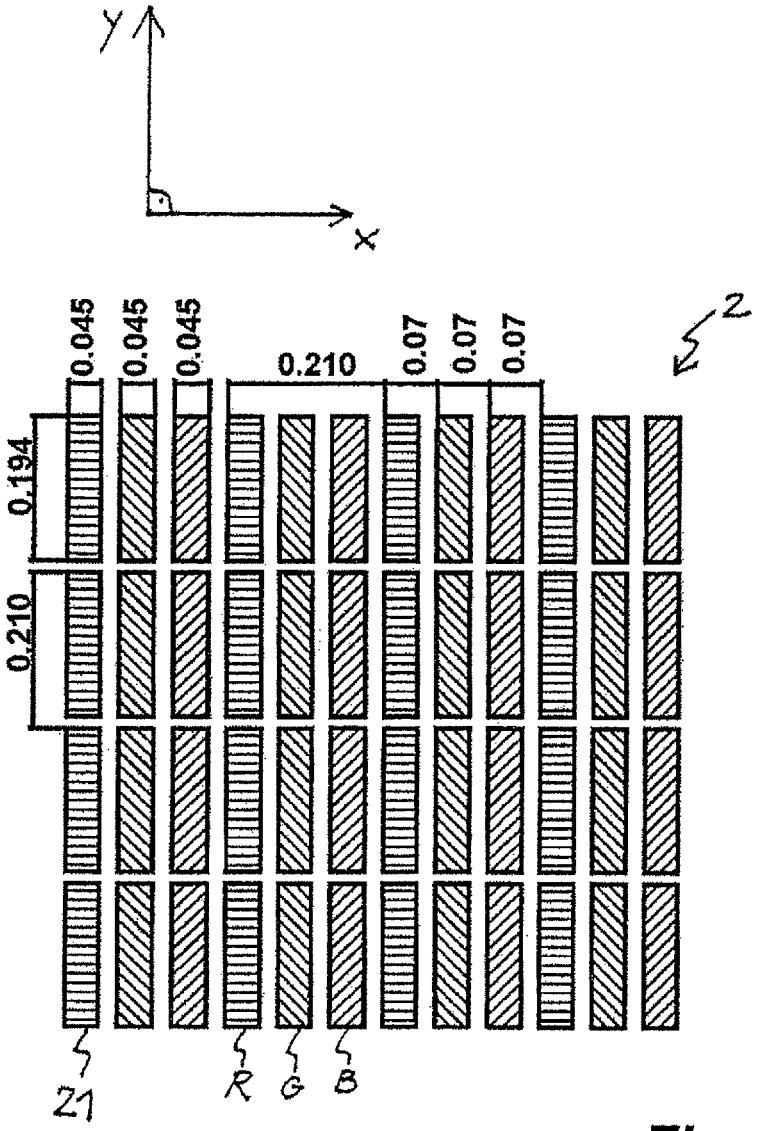
FIG. 10 a luminous layer in the form of a pixel matrix.

FIG. 10 shows a light-emitting luminous layer in the form of a pixel matrix, consisting of individual pixels 21, which each emit red, green or blue light. The matrix consists of rows in the x direction and of columns in the y direction. In this example, each pixel 21 has a dimension of 0.045 mm in the x direction and of 0.194 mm in the y direction. The pixels are arranged in a periodic grid that has a period of 0.07 mm in the x direction and of 0.210 mm in the y direction. The color sequence within a row is red (=R), green (=G), blue (=B), while only one single color occurs in a column in each case. Preferably, the individual pixels 21 are realized as an LED, e.g. as an OLED.

The registering of the pixel matrix with the mask layer may also be effected by software. In this case, measurement is effected to determine the combination of luminous pixels at which the desired effect is optimal with the mask layer. Alternatively, the display may show a sequence of combinations of luminous pixels, with the objective that one of the combinations is as close as possible to the optimum.

Another possible design of a luminous layer in the form of a pixel matrix is a matrix arrangement of 128×128 pixels (RGB), the matrix having overall dimensions of 33.8 mm×33.8 mm.

A further possible design of a luminous layer is a full-area OLED. Such OLEDs may, for example, give light over their full surface area, over 10 mm×10 mm. Standard colors of OLEDs are currently green, red or white.

It is possible for a mask layer, in the form of a foil, to be arranged above one of the luminous layers described above, wherein the distance between the luminous layer and the mask layer may be approximately 0.7 mm. A lesser distance is more advantageous for the majority of applications, however, as explained in greater detail later with reference to FIG. 22.

Figure 11:
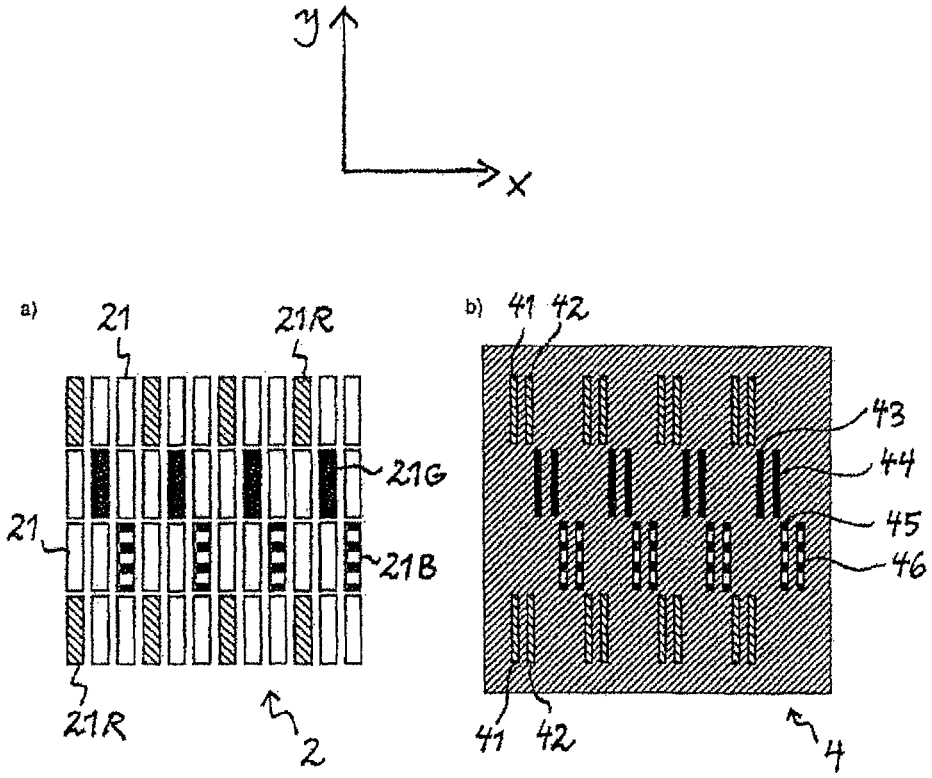
FIG. 11 a top view of an embodiment example of a luminous layer and of a mask layer matched to the latter.

FIG. 11 shows an embodiment example of a luminous layer 2 (FIG. 11*a*) and a mask layer 4 (FIG. 11*b*), by means of which colored images can be generated. With such a structure of the luminous layer 2 and mask layer 4, it is even possible to generate different optical effects for different colors. FIG. 11*a* shows a top view of a matrix consisting of pixels 21, which are divided into rows in the x direction and columns in the y direction. The spacings and dimensions correspond to those of the matrix represented in FIG. 10. The individual pixels are controlled in such a manner that, in a row, only pixels of a single color radiate light in each case, i.e. in the topmost row, only the red pixels 21R light up, in the row below it only green pixels 21G light up, in the row below that only blue pixels 21B light up, and in the lowermost row, at the start of a new cycle, again only red pixels 21R light up. The mask layer shown in FIG. 11*b* has a different arrangement of openings for each of the colors R, G and B, i.e. the arrangements 41 and 42 for the red pixels 21R, the arrangements 43 and 44 for the green pixels 21G, and the arrangements 45 and 46 for the blue pixels.

Since one opening can be realized for each pixel, or for each pixel group, entirely independently of the other openings, a different effect can be generated for each light color R, G and B. In this way, an observer perceives an effect resulting from the interaction of the red luminous elements 21R with the "red" openings 41, 42, if the red pixels 21R that are assigned to these openings 41 and 42 are activated.

An entirely different optical effect occurs if the blue pixels 21B are activated, etc. In this way, it is possible, e.g., to generate "true color" 3D images. If the luminous layer and mask layer are realized in this manner, an alignment in the x and y directions is necessary, with the result that the correct openings 41 to 46 come to rest above the corresponding luminous elements 21.

Figure 12:
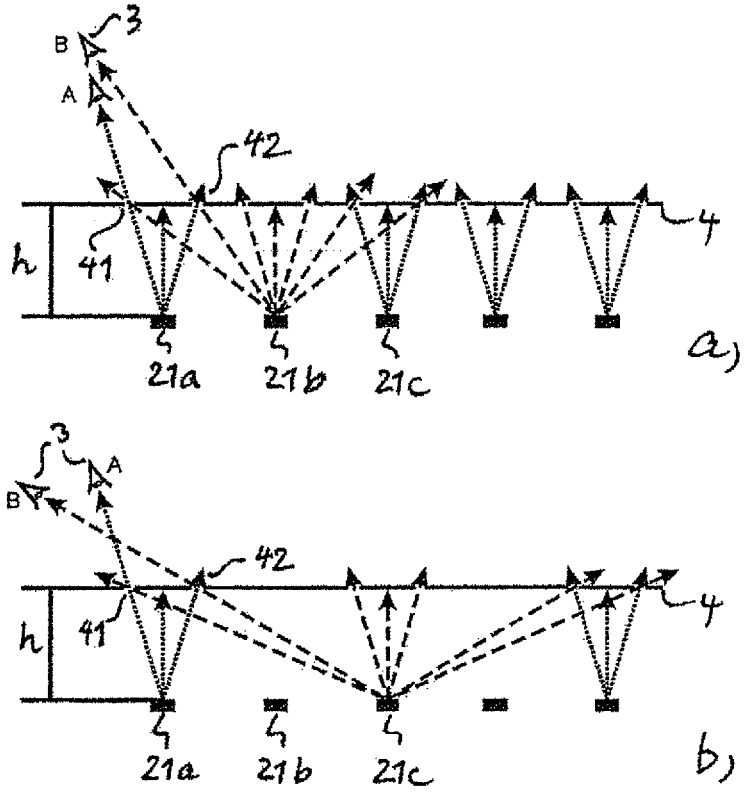
FIG. 12 a side view of various arrangements of luminous layer and mask layer to explain "crosstalk"

FIG. 12*a* illustrates a problem known as "crosstalk", which consists in that light emitted or provided by two adjacent luminous elements 21*a* and 21*b* reaches a viewer 3 through the same openings 41 and 42. Close examination of FIG. 12*a* to reveals that, from the angular position A, the viewer receives light from the first luminous element 21*a*, this light reaching the viewer through the opening 41, which is assigned to the first luminous element 21*a*. At an only slightly altered angular position B, the viewer 2 receives light from the adjacent luminous element 21*b*, this light reaching the viewer 3 through the opening 42, which is likewise assigned to the first luminous element 21*a*. The fact that light from the second luminous element 21*b* passes through the opening 42 assigned to the first luminous element 21*a* is referred to by the technical term "crosstalk". A solution to this problem is represented in FIG. 12*b*. The solution consists in that the distance between the luminous elements is increased. This can be realized, e.g., in that only every second or every third row of luminous elements 21 is activated. In the case of the example shown in FIG. 12*b*, the luminous element 21*b* has been deactivated, with the result that no crosstalk can occur between the two adjacent luminous elements 21*a* and 21*b*. Although it is indicated that crosstalk can also occur between the two luminous elements 21*a* and 21*c*, because light from the luminous element 21*c* can pass through the opening 42, which is assigned to the first luminous element 21*a*, in this case the crosstalk nevertheless only occurs if there is a significantly greater alteration of the viewing angle, i.e. in the case of an alteration of the viewing angle from the position A to the position B. Such a large alteration of the viewing angle is not effected inadvertently, with the result that there is no risk of inadvertent crosstalk in this case.

As an alternative to increasing the spacing of the luminous elements, the spacing, or period, of the transparent openings may also be increased. This, likewise, has the effect of reducing the "crosstalk".

Figure 13:
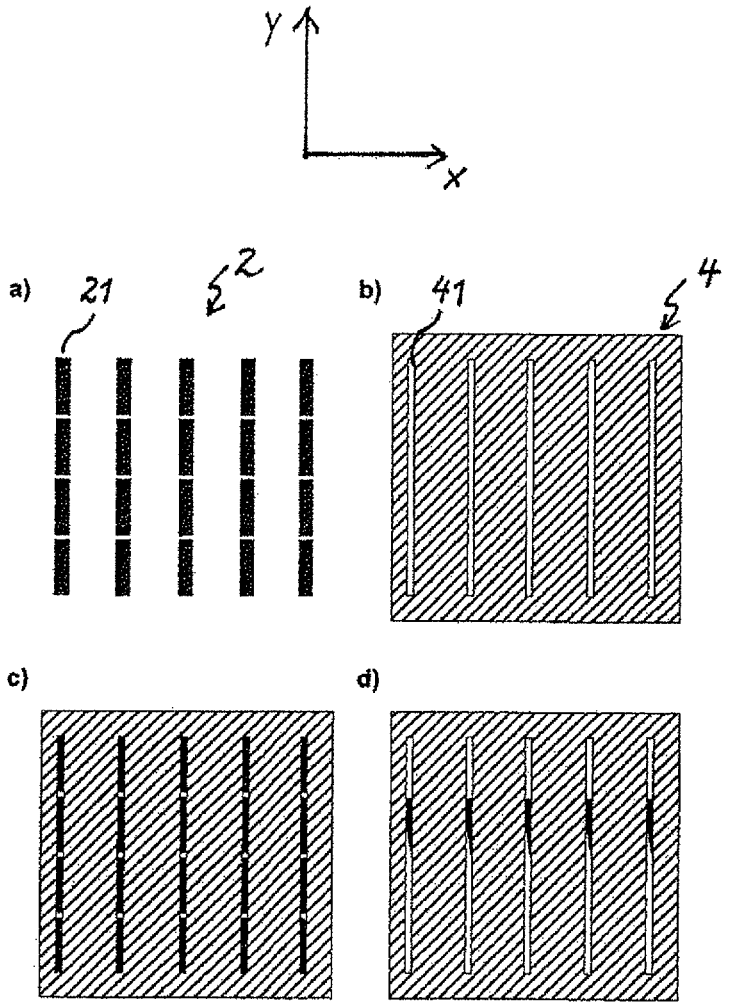
FIG. 13 a top view of various arrangements of luminous layer and mask layer to explain the angular alignment.

FIG. 13 illustrates a problem relating to the angular alignment. FIG. 13*a* shows a top view of a luminous layer consisting of a grid of separate luminous elements 21, which are arranged uniformly in rows and columns. The dimensions and sizes of the individual luminous elements 21 correspond to those from FIG. 10. FIG. 13*b* shows a top view of a mask layer 4 having an arrangement of linear openings 41, which are arranged in a grid with a spacing of 0.210 mm. The luminous layer 2 thus consists of light-imitating lines 21 having a grid spacing of 210 μm, and the mask layer consists of linear window openings, likewise having a grid spacing of 210 μm. A security element is realized in which the mask layer 4 is arranged above the luminous layer 2. If the luminous layer 2 and the mask layer 4 are correctly aligned in relation to each other, i.e. with the result that a maximum transmission results, the openings 41 in the mask layer 4 are completely parallel to the columns of the luminous layer 2 that extend in the y direction. Moreover, the lateral position, i.e. the positioning of the mask layer 4 upwards and downwards, and to the left and right, is matched, in the plane of the drawing, to the middle columns 21 of the luminous layer 2, as represented in FIG. 13*c*. If the angular alignment of the mask layer 4 deviates only slightly from the correct position in respect of the luminous layer 2, only a small amount of light passes through the mask layer, as shown in FIG. 13*d*. In the production of a security element according to the invention, therefore, it is necessary to align the mask layer 4 with the luminous layer 2, both laterally and in respect of the angle. Preferably, the angular alignment of the mask layer 4 in respect of the luminous layer 2 is better than 0.5°, in particular better than 0.1°.

For the purpose of producing such security elements, e.g. for ID cards, it may therefore be advantageous to effect active positioning during the production process. It is conceivable, in a production process, to use an image recognition system that evaluates the optical effect with backlighting, or with the luminous layer switched on, to control the operation of arranging the mask layer 4 and the intermediate layer 6, or luminous layer 2, in a precise manner in relation to each other in respect of angle and/or position. It is also possible, during production, to provide mask layers with built-in alignment marks, to make it easier to achieve angular and lateral accuracy in registering the mask layer in relation to the individual luminous elements of the luminous layer.

Figure 14:
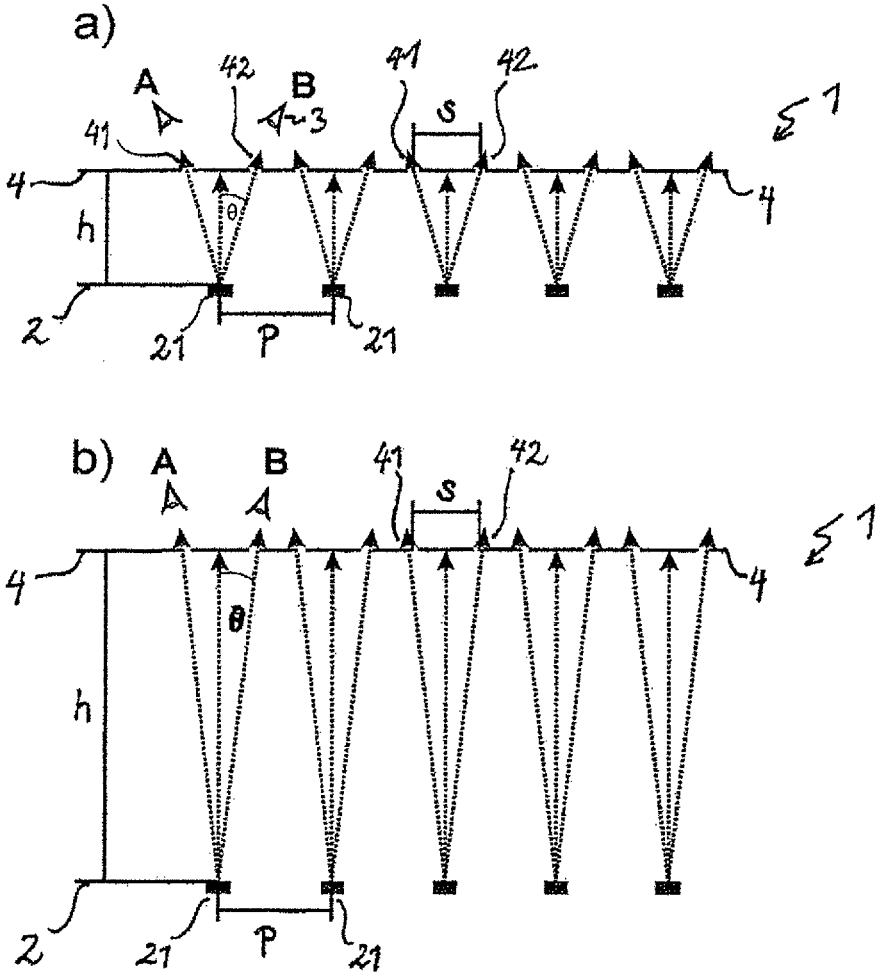
FIG. 14 a side view of various arrangements of luminous layer and mask layer to explain the angular separation.

FIG. 14 illustrates a problem relating to the angular separation of images. FIG. 14*a* shows a section of a security element 1, comprising a luminous layer 2, with individual luminous elements 21 that are arranged at a lateral distance p from each other and, arranged above them, a mask layer having a first 41 and a second 42 arrangement of openings, with the result that light of a luminous element 21 can reach the eye of a viewer 3 through the openings 41, 42, in the case of two predefined angular positions A and B. In addition to being determined is by the lateral distance s of the openings 41, 42 assigned to the luminous element 21, the angle θ, which indicates the emergence angle of the light from a luminous element 21 through an opening 41, 42 assigned to the latter, is also determined by the vertical distance h between the mask layer and the luminous layer 2. For a security element 1 having the exemplary dimensions p=200 μm, h=200 μm and s=120 μm, the angle θ=arctan (60 μm/200 μm)=16.7°. For the two images A and B, a total angular separation of approximately 34° is thus obtained, which represents an angular separation appropriate for practical application. However, if the covering layer of the luminous layer 2 is considerably thicker, i.e. if the vertical distance h assumes substantially greater values, the situation changes.

FIG. 14*b* shows such an arrangement, in which the vertical distance h is considerably greater than in the embodiment example shown in FIG. 14*a*. If, e.g., h=600 μm, the emergence angle changes to the following value: β=arctan (60 μm/600 μm)=5.7°. This means that, for large vertical distances h between the luminous layer 2 and the mask layer 4, the angle β is relatively small, and not ergonomic. For large distances of the luminous elements 21 from the window openings 41, 42, it is advantageous to use only every second row of luminous elements 21, or even only every third or fourth row. Usually, the ratio s/h, i.e. the quotient of the lateral distance s and the vertical distance h, is in the range of from ⅕ to 10. Preferably, the ratio s/h is in the range of from ⅓ to 4. Moreover, this problem can be mitigated to a large extent if the mask layer 4 is simultaneously an electrode of the luminous layer 2, a design that is explained in more detail further below. In the case of such a design, the distance between the luminous layer 2 and the mask layer 4 is significantly less than in the case of the embodiment example shown in FIG. 14*b*.

Figure 15:
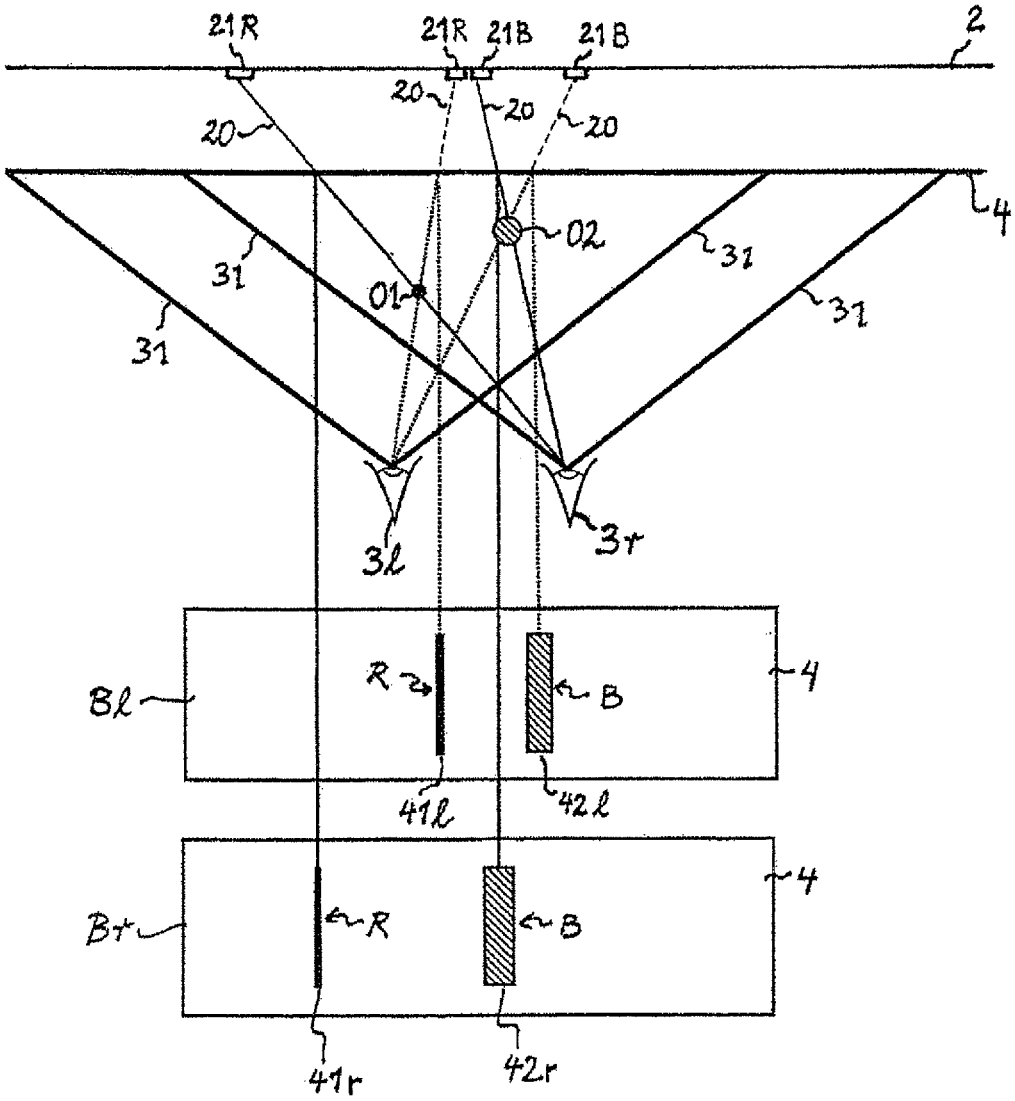
FIG. 15 side and top view of an arrangement of luminous layer and mask layer for realizing a stereoscopic image.

A section of a mask layer 4 that is viewed by a viewer, with a left eye 3*l* and a right eye 3*r*, is shown in the upper part of FIG. 15. Arranged behind the mask layer, in the viewing direction, there is a luminous layer 2 having separate luminous elements 21R, 21B, which each respectively radiate or provide either red light R or blue light B. These luminous elements 21R, 21B may be realized, e.g., as LED pixels. The unbroken lines 31 indicate the limits of the field of view of the eyes 3*l*, 3*r*. For the viewer 3, two cylindrical objects O1, O2 appear to float in front of the mask layer 4, in the viewing direction. The first object O1 is red, closer to the viewer 3*l*, 3*r*, and smaller than the other, blue object O2, which floats to the right of the first object O1 in the viewing direction. The viewer 3*l*, 3*r* has the impression of a 3D image. This stereoscopic image is realized by a design of the mask layer 4 in which items of information reaching the left eye 3*l* of the viewer differ from those reaching his right eye 3*r*. The broken or unbroken lines 20 indicate the course of light beams of red or blue light that reaches the eyes 3*l*, 3*r* of the viewer, through the mask layer 4, from the luminous elements 21R, 21B.

A top view of the mask layer 4 is shown in the lower part of FIG. 15, wherein, in order to simplify the representation, the arrangement of openings 41*l*, 42*l* and 41*r*, 42*r* assigned to each eye 3*l*, 3*r*, respectively, is represented in a separate partial image. The upper top view Bl of the mask layer 4 shows the position of the openings 41*l*, 42*l* that allow light intended for the left eye 3*l* to pass through to the left eye 3*l*. The lower top view Br of the mask layer 4 shows the position of the openings 41*r*, 42*r* that allow light intended for the right eye 3*r* to pass through to the right eye 3*l*. The two narrower openings 41*l*, 41*r* allow red light R, from luminous elements giving red light, to reach the viewer, and the two broader openings 42*l*, 42*r* allow blue light B, from luminous elements giving blue light, to reach the viewer. The position of the openings 41*l*, 42*l* and 41*r*, 42*r* on the mask layer 4 in the lower part of FIG. 15 results from the fact that the points of intersection of the light beams 20 with the mask layer 4, represented in section in the upper part of FIG. 15, are transferred vertically into the lower part of FIG. 15. These transfer lines—unbroken or broken—are indicated without references.

Thus, in the mask layer 4, the openings 41*l*, 42*l*, 41*r*, 42*r* are matched to differing luminous elements of a luminous layer 2 that is arranged behind the mask layer 4 in the viewing direction, such that the left eye 3*l* sees the partial image denoted by Bl, and the right eye 3*r* sees the partial image denoted as Br. Owing to the fact that the two partial images Bl, Br, which are each perceived by one of the two eyes 3*l* and 3*r*, respectively, are superimposed in the brain of the viewer, the viewer has the impression of a 3-dimensional arrangement of the two objects O1 and O2. A viewing distance similar to the normal reading distance, thus approximately 20 to 40 cm, is assumed in this case.

The arrangements for representing 3-dimensional, i.e. stereoscopic, images are basically analogous to those for realizing an image changeover ("image flip").

Figure 16:
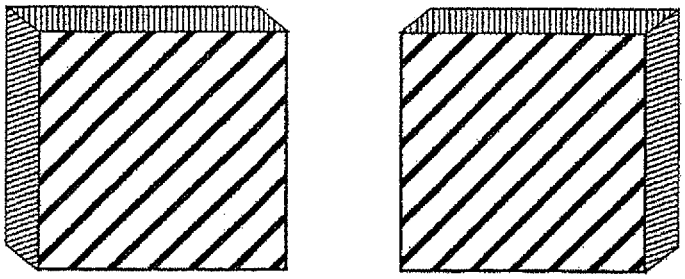
FIG. 16 two calculated half-images of a cube.

The conventional way of generating stereo images is to use a special twin-lens stereoscopic camera. However, it is simpler to model an object in the computer and to calculate the two half-images that are perceived by the left and the right eye. This procedure is shown schematically in FIG. 16, in that a cube having dimensions of 20 mm×20 mm is shown. It is assumed in this case that the left and the right eye are 80 mm apart from each other, and that the eyes are at a distance of 300 mm from the cube and are raised vertically 60 mm above the centre of the cube. FIG. 16 shows the two half-images calculated on the basis of these geometric parameters by means of the Mathematica® software.

Figure 17:
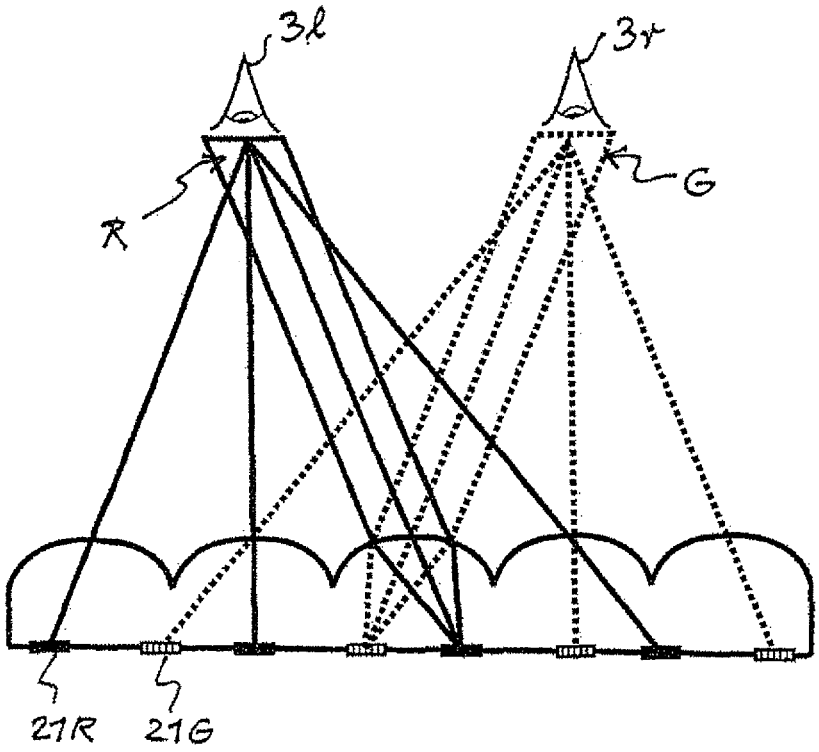
FIG. 17 an arrangement for realizing anaglyph images.

A standard method of combining the two images, as they are shown in FIG. 16, uses anaglyph images: the two half-images generated by the luminous elements 21R, 21G, which give red and green light, respectively, are presented in a superimposed manner, wherein the left image is colored red R and the right image is colored green G, as shown in FIG. 17. Such stereoscopic viewing requires the use of special spectacles, of which the left lens is colored red and the right lens is colored green.

Since a red image cannot be seen through a red-colored lens, and vice versa, each eye 3*l*, 3*r* sees only one half-image in each case, with the result that a stereoscopic impression can be generated. This method functions very well on computer monitors. In this case, there are several possible combinations, e.g. red/green or green/red or red/cyan or blue/red, etc.

Figure 18:
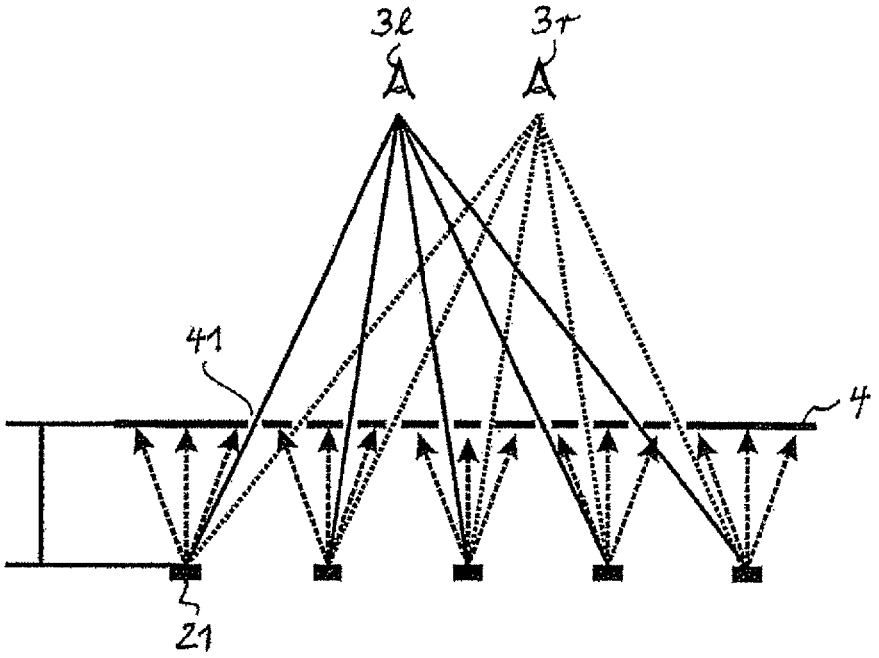
FIG. 18 a further arrangement of luminous layer and mask layer for realizing a stereoscopic image.

In order to generate such a stereoscopic image having a security element according to a design of the present invention, the two partial images are transferred in a gridded manner to the mask layer 4, e.g. by demetallization of an OVD, the metallic reflection layer of which serves as mask layer 4. In this way, the mask layer 4 is provided with openings at those locations that, respectively, allow light from the luminous elements 21 to reach the left eye 3*l* and the right eye 3*r* of a viewer, with the result that the respective stereoscopic half-image can be perceived by the viewer, as shown schematically in FIG. 18. This method is analogous to the calculations that are required for an anaglyph image. In this case, the window openings 41 in the mask layer 4 determine the image points that are seen, respectively, by an eye 3*l*, 3*r*. In this case, the same challenges such as, e.g., crosstalk or resolution, etc. remain for this variant as for the variants explained above, wherein the solution possibilities are similar.

Figure 19A:
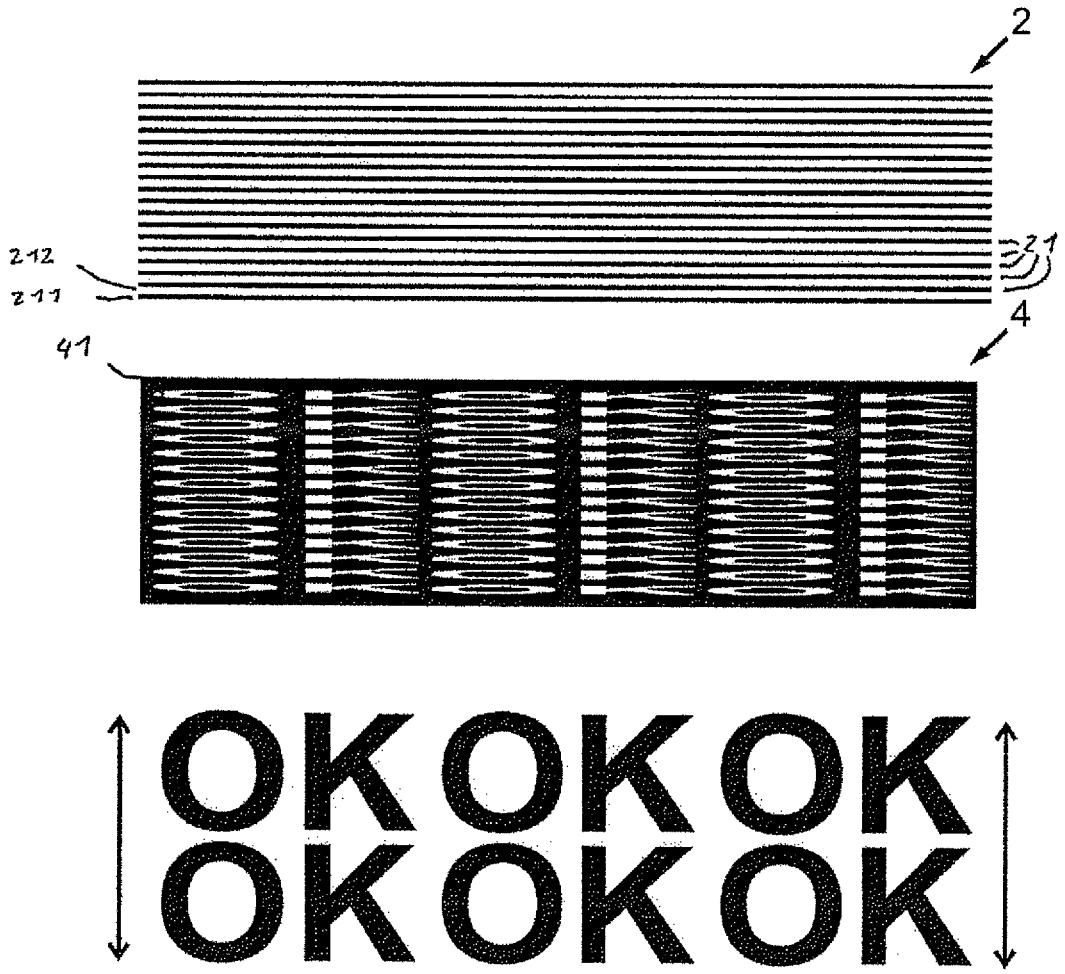
FIG. 19*a* a luminous layer and mask layer for realizing a moiré magnification.

FIG. 19*a* illustrates the structure of a security element for realizing a moiré magnification effect, which is also known by the specialist terms "shape moiré" or "band moiré".

According to one design of the present invention, a moiré magnification arrangement is realized with the following structure: in this case, a revealing layer, constituted by a luminous layer 2 having linear first zones 211, in which the luminous layer 2 can emit or provide light, is located beneath a base layer constituted by a mask layer 4 having periodically arranged, identical openings 41 of a particular shape. Here, the first zones 211 are separated from each other by one or more second zones 212, in which the luminous layer cannot emit or provide light. The first zones 211 in this case are preferably each realized by one or more luminous elements. Thus, FIG. 19*a* shows a corresponding representation in which the first zones 211 are each realized by a linear luminous element 21, the radiating region of which has a linear shape, and each of which realizes one of the first zones 211.

FIG. 19*a* shows the luminous layer 2, which serves as an emitter layer, and the mask layer 4 that is arranged above it, wherein the openings 41 in the mask layer 4 each show the letter combination OK. Following conventional practice, the term "above" is to be understood to mean in the viewing direction. The mask layer 4 is above, i.e. in front of, the luminous layer 2 in the viewing direction. The resultant visual impression is shown separately in the lower part of FIG. 19*a*: the shape OK appears in magnified form to a viewer and, depending on the viewing direction, the shape OK appears to move vertically (indicated by the arrows).

Figure 19B:
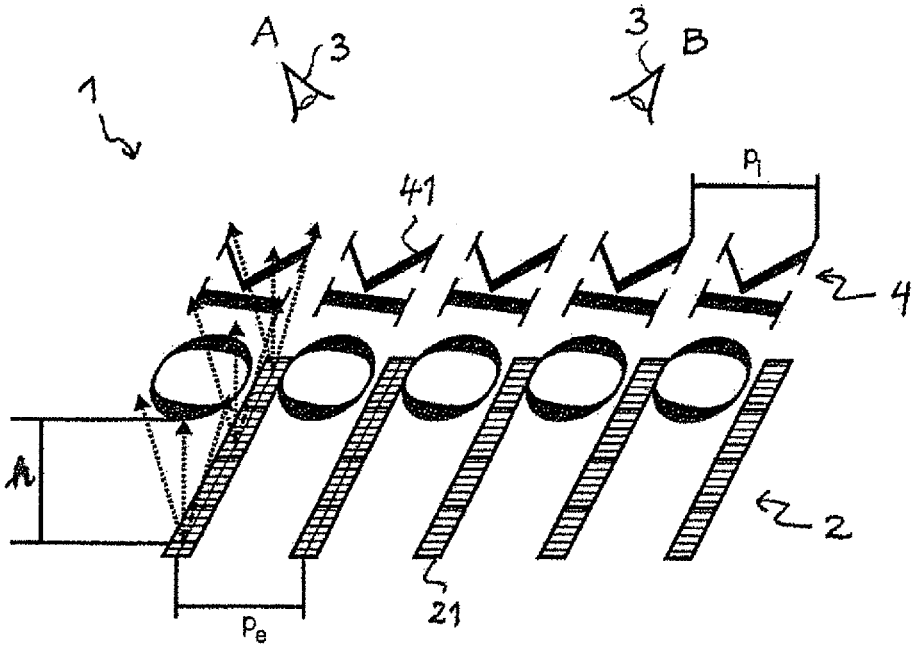
FIG. 19*b* an arrangement for realizing a moiré magnification.

FIG. 19*b* shows the geometric arrangement of the luminous layer 2 and mask layer 4, shown in FIG. 19*a*, in a security element 1. The two layers 2 and 4 are spaced apart from each other by a vertical distance h, the period $p_e$ of the grid, according to which the first zones 211, or the luminous elements 21, of the luminous layer 2 are arranged, is typically in the range of from 10 to 500 μm, preferably of 50 to 300 μm, e.g. $p_e$=0.21 mm. The grid according to which the openings ("images") 41 in the mask layer 4 are arranged has a period $p_i$ of 0.22 mm. A viewer 3 of the security element 1 then perceives magnified images of the openings 41, which are tilted downwards in comparison with the original openings 41, having a size $p_m$ of approximately 5 mm:

$$p_m = \frac{p_i \cdot p_e}{p_i - p_e} = -\frac{0.22\ \text{mm} \cdot 0.21\ \text{mm}}{0.22\ \text{mm} - 0.21\ \text{mm}} - 4.6\ \text{mm}$$

FIG. 19*b* shows the openings 41 colored black, in order to simplify the geometric representation of the luminous layer 2 and mask layer 4. Obviously, in reality, in the preferred embodiment, the openings 41 are transparent and surrounded by opaque regions.

Moreover, however, it is also possible for the regions shown in the color black in FIG. 19*b* to be opaque in the mask layer 4, and for the surrounding regions to be transparent and constitute the openings 41.

If the luminous elements 21 of the luminous layer 2 are not active, or not providing light, a viewer 3 does not perceive the images 41. It is only when the luminous layer 2 is activated, and emits or provides light, that the viewer 3 sees the word "OK". This image is formed by the light beams that exit the luminous elements 21 in the angular direction of the eye of the viewer 3 and are transmitted through the micro-images 41. If the security element 1 is tilted from left to right, about an axis along the longitudinal axis of the luminous elements 21, light beams are transmitted at differing angles through the micro-images 41, and the magnified image created appears to move, as indicated in the lower part of FIG. 19*a*.

Figure 20:
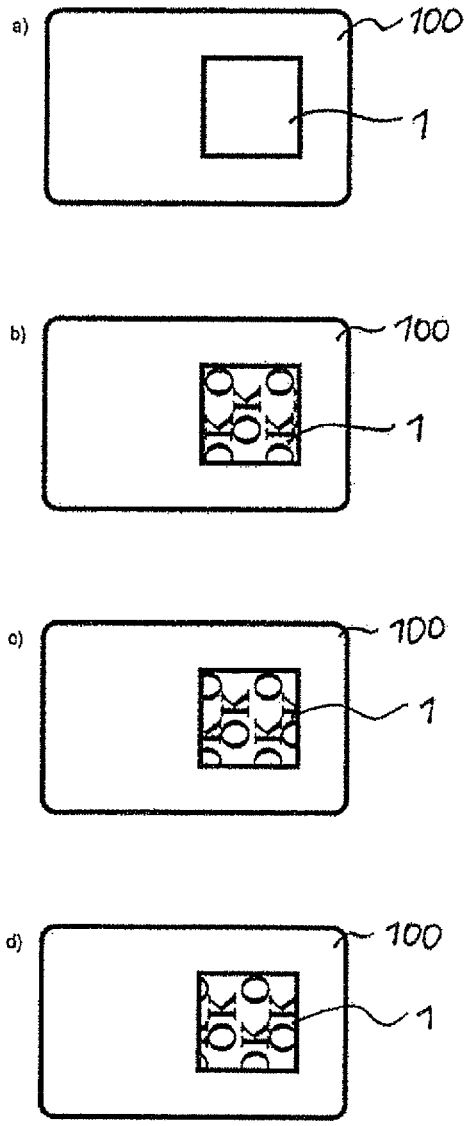
FIG. 20 optical effects of a moiré magnification.

Shown schematically in FIG. 20 are optical effects of a moiré magnification that are possible with the security element 1 already explained in connection with FIGS. 19*a* and 19*b*. FIG. 20*a* shows a view of a security document 100, e.g. an ID card, on which the security element 1 has been applied. In FIG. 20*a* the luminous layer is inactive, i.e. no light is being emitted or provided. In this case, the items of information that are present in the form of openings in the mask layer in the security element 1 are not visible, being, as it were, "hidden". These items of information preferably exist as micro-images, which are represented in magnified form, owing to the moiré magnifier effect, when illuminated by the luminous layer.

FIGS. 20*b* to 20*d* show optical effects of the security element 1 when the luminous layer is active, i.e. when it is emitting or providing light. In these cases, the items of information that are present in the form of openings in the mask layer in the security element are visible.

FIG. 20*c* shows the optical effect of the security element when the plane of the security element 1 is viewed perpendicularly from above. FIG. 20*c* shows the optical effect of the security element 1 when it is viewed from the left, and FIG. 20*d* shows the optical effect of the security element 1 when it is viewed from the right: as the viewing angle is altered, the items of information appear to move, since in each case light beams are transmitted at differing emergence angles through the mask layer.

Moreover, it is also possible for the security element to have a structure that is the inverse of the structure explained with reference to the figures FIG. 19*a* and FIG. 19*b*. Thus, it is possible for the mask layer 4 to constitute the revealing layer and to have, for example, a sequence of linear openings in the mask layer 4, and for the luminous layer 2 to constitute the base layer. It is thus possible, for example, for the luminous layer 2 to have a multiplicity of first zones in which the luminous layer can emit or provide light, and which are each realized in the form of a micro-image. It is thus possible, for example, for these first zones to be configured according to the openings 41 in the mask layer 4 according to FIG. 19*a*, and to be surrounded by a second zone of the luminous layer, in which the luminous layer does not emit light, or cannot emit or provide light. Moreover, it is possible for example, for the openings in the mask layer to have the linear shape of the luminous elements 21 according to FIG. 19, and therefore for the openings in the mask layer to be configured and arranged according to the sequence of first zones 211 shown in FIG. 19*a*, as a result of which the effect explained with reference to the figures FIG. 19*a* to FIG. 20*d* is obtained in an analogous manner.

Figure 21A:
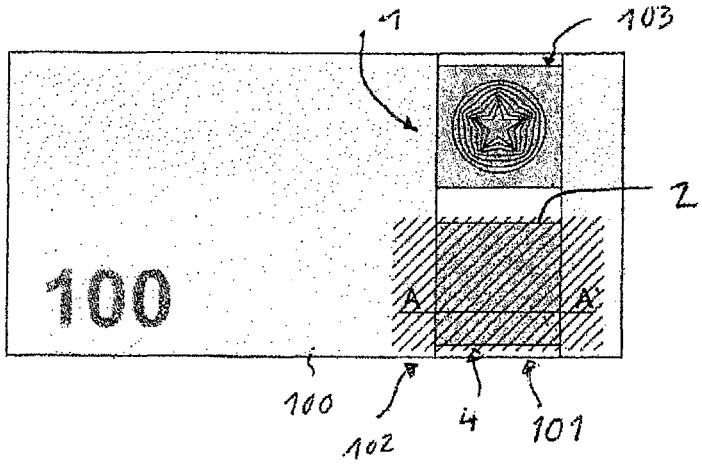
FIG. 21*a* a schematic top view of a security document.
Figure 21B:
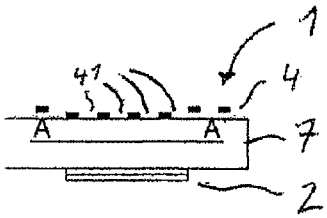
FIG. 21*b* a schematic sectional representation of a portion of the security document according to FIG. 21*a;*

FIG. 21*a* and FIG. 21*b* show a security document 100 having a security element 1 that has such a structure: the security element 1 has a substrate 7, which has the mask layer 4 provided on one side and has a luminous layer 2 provided on the other side. The mask layer 4 in this case has a multiplicity of openings 41, which have a linear shape or are in the shape of a strip, as shown in FIG. 21*a*, and which are arranged according to a periodic grid. Also provided is a luminous layer 2, which has a multiplicity of first zones, in which the luminous layer 2 can emit or provide light, and which are each configured in the form of a micro-image. The first zones in this case are likewise preferably arranged according to a periodic grid, for example according to a periodic one-dimensional grid. The periods of the grids preferably correspond to the relationships explained previously with reference to the figures FIG. 19*a* and FIG. 19*b*.

In the case of the embodiment example according to FIG. 21*a* and FIG. 21*b*, the mask layer 4 is preferably constituted by a printed layer that is printed on, for example, by intaglio printing, offset printing, gravure printing or screen printing.

If the security document 100 is constituted, for example, by a banknote or an ID document, this banknote is preferably realized such that the carrier substrate of the banknote or ID card has a transparent window that is overprinted with the mask layer 4 on one side. The luminous layer 2 is then applied on the back side of this transparent window, for example applied in the form of a laminating foil or the transfer layer of a transfer foil.

If the security document is an ID card, the light-emitting elements are preferably arranged between two layers, of which the front layer is transparent. An imprint constituting the mask layer is then preferably applied above the light-emitting elements, preferably being applied to the upper surface of the card body.

The security document 100 is preferably a polymer banknote that has a transparent plastic film as carrier substrate, for example a BOPP film having a layer thickness of between 70 and 150 μm. This carrier substrate then preferably constitutes the substrate 7 of the security element 1. This carrier substrate is then printed on both sides, in order to provide the corresponding design of the banknote. In this printing operation, a window 101 is created, having, for example, the shape of a stripe shown in FIG. 21*a* and extending over the entire width of the banknote. The mask layer 4 is then applied on one side of the banknote 101, as shown in FIG. 21*a*, preferably by printing. A foil element, for example a laminating foil or a transfer layer of a transfer foil is then applied to the opposite side of the security document 100, the foil providing the luminous layer 2 in a region 102 of the security document 100 and, for example, providing a further security element, for example a Kinegram®, in a further region 103. Preferably in this case, the mask layer 4 is imprinted before the luminous layer 2 is applied, so that damage to the luminous layer 2 as a result of the printing process is precluded as far as possible. It is also possible, however, to apply the luminous layer 2 first and only then to imprint the mask layer 4.

Figure 21C:
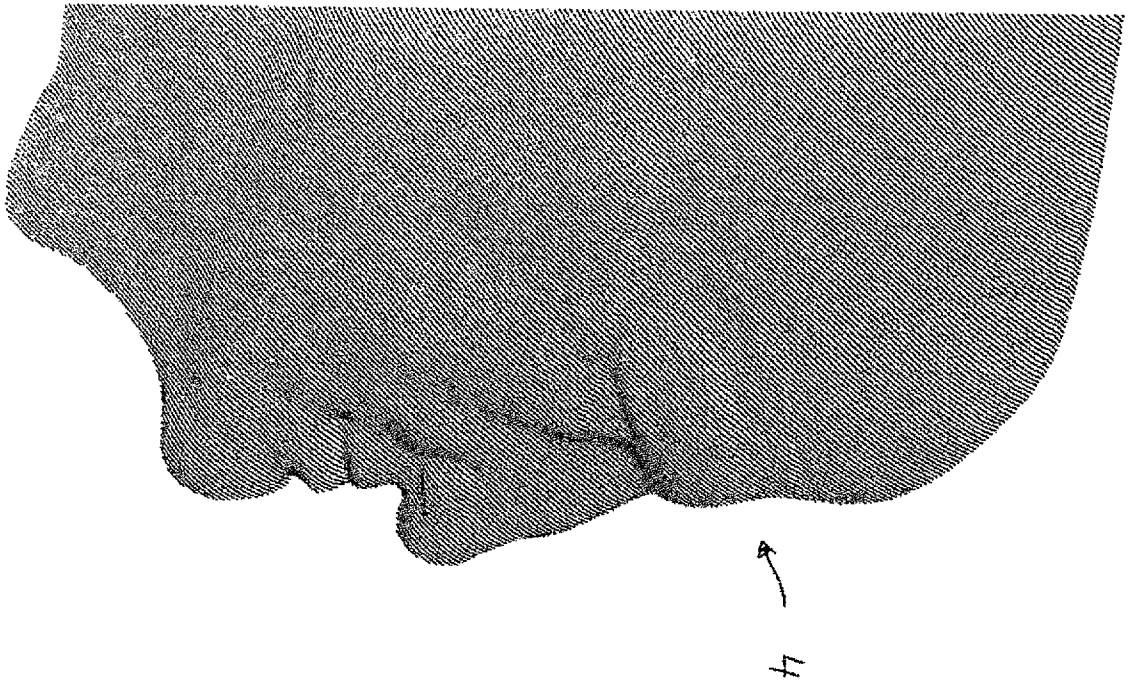
FIG. 21*c* a schematic, enlarged top view of a mask layer.
Figure 21D:
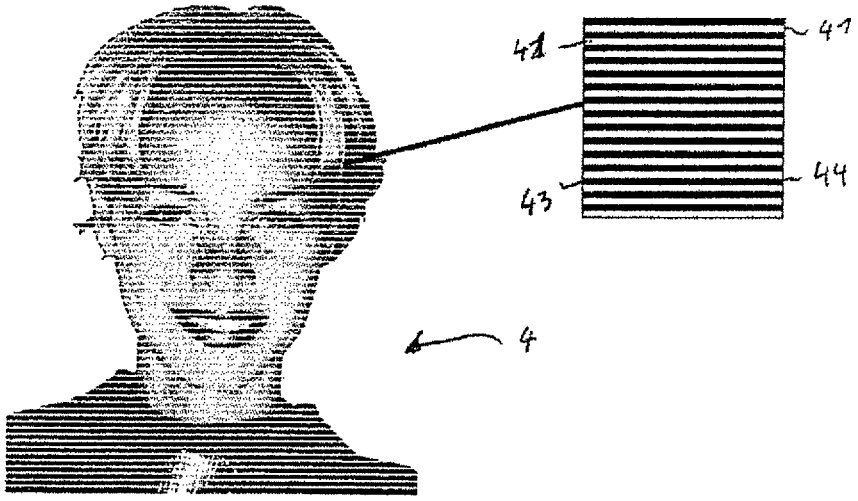
FIG. 21*d* a schematic, enlarged top view of a mask layer.
Figure 21E:
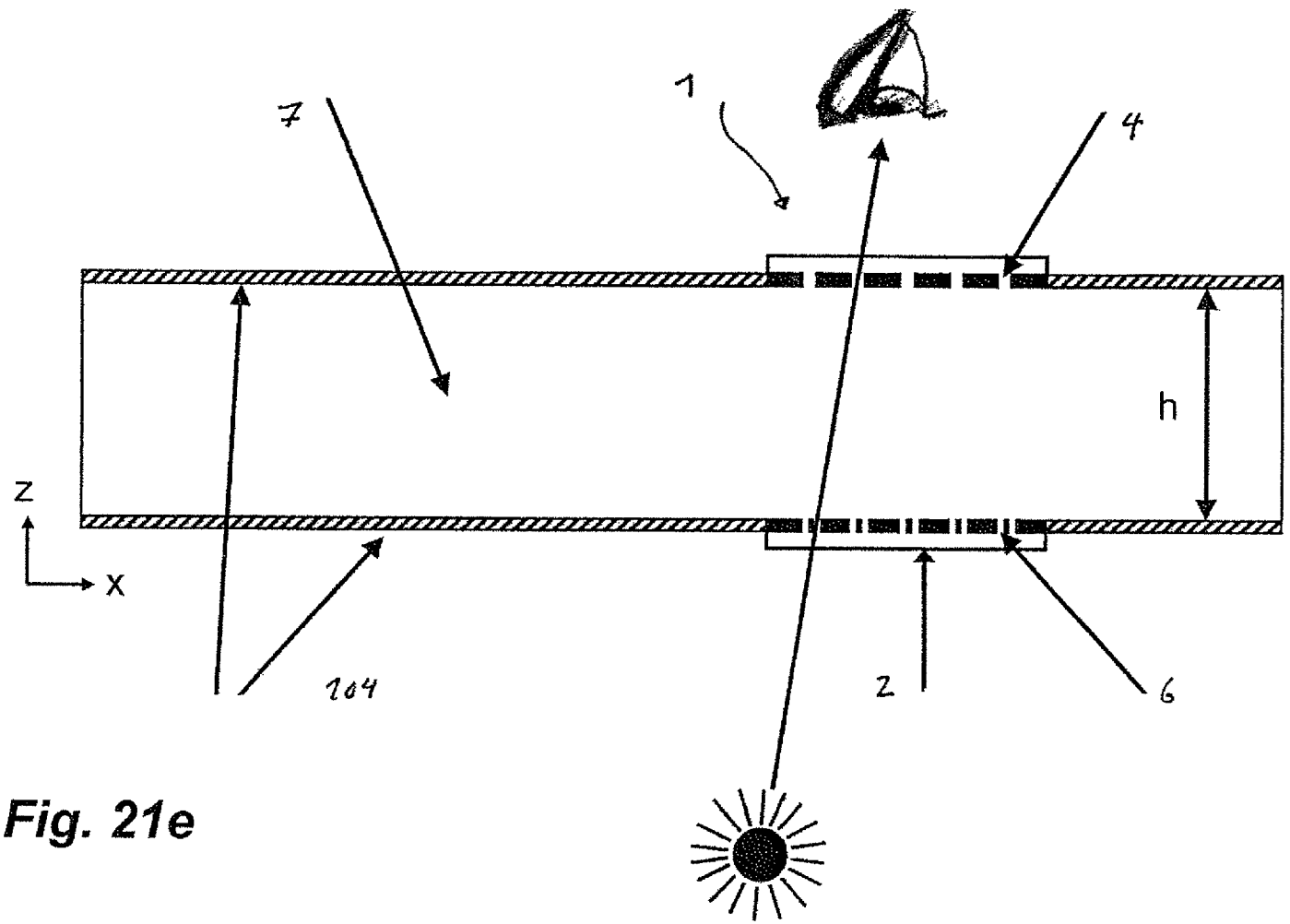
FIG. 21*e* a schematic sectional representation of a security document having a security element.

FIG. 21*e* shows a further example of a security element 1 which is inserted in a window of a security document, in particular of a banknote. Both the mask layer 4 and the luminous layer 2 are applied as foil element, for example a laminating foil or a transfer layer of a transfer foil. FIG. 21*e* shows this in a schematic side view of a banknote having a transparent core, i.e. transparent substrate 7 that, as shown in FIG. 21*e*, may optionally be provided with a printed layer 104, which may be constituted, for example, by an RGB intaglio imprint. Visible light from an external light source, e.g. a ceiling lamp giving white light, illuminates the security element 1 from the back side. The light is incident on the luminous layer 2—e.g. the protective layer of a Kinegram patch—and passes the light on to the intermediate layer 6 having the transparent openings, in the form of the moiré information. In this example, the intermediate layer is a metallized patch having demetallized regions that constitute the transparent openings. Some of the light goes through the intermediate layer 6, the transparent core of the substrate (here, a polymer banknote) and the mask layer 4, through the transparent openings, and thereby generates the desired effect, e.g. moiré magnifications and/or movements.

Figure 21G:
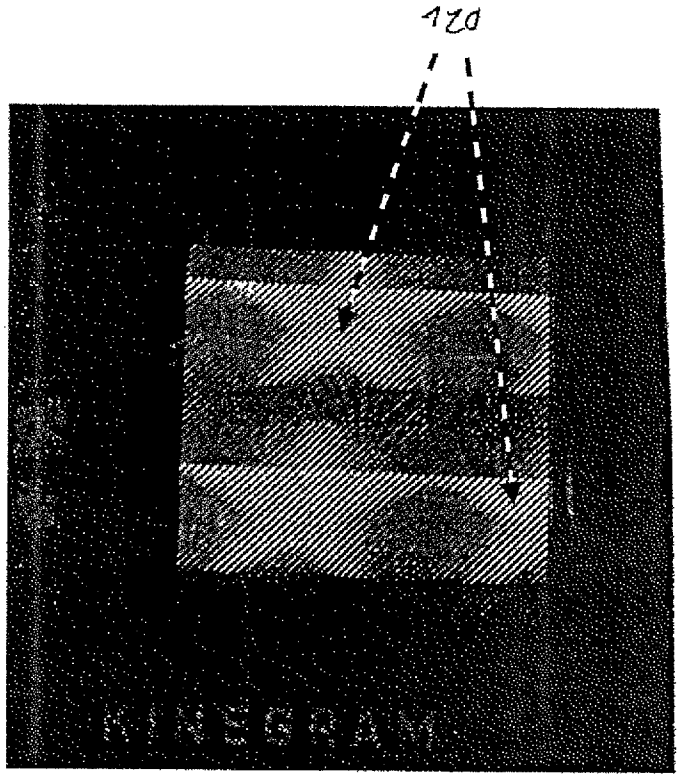
FIG. 21*f* and FIG. 21*g* Photos of the optical effects provided by the security element according to FIG. 21*e;*
Figure 21F:
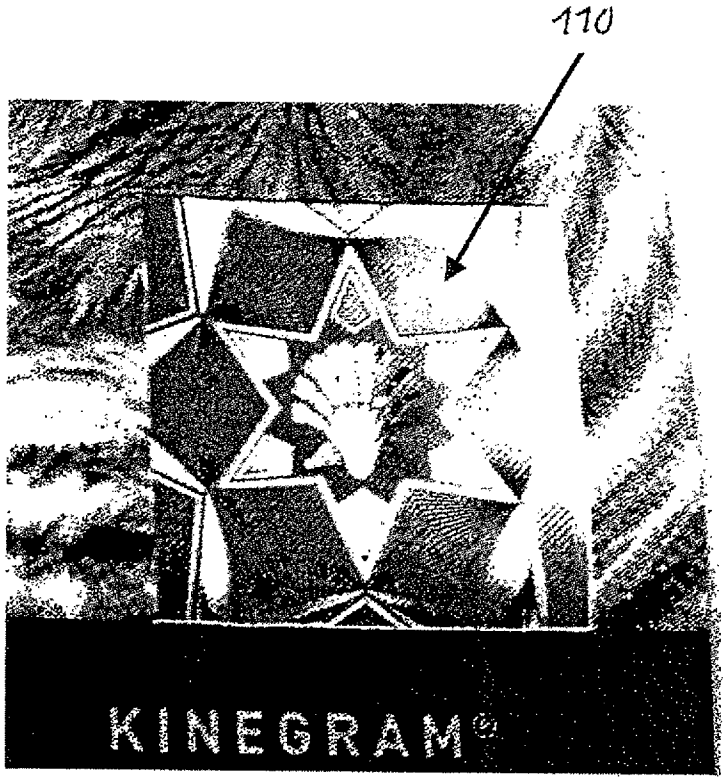

Photos of the optical effect exhibited when the security element 1 is viewed with reflected light and with back-light are shown in the figures FIG. 21*f* and FIG. 21*g*, respectively. The figure FIG. 21*f* shows a photo of the optical effect provided by the security element 1 when viewed with reflected light. The optically variable appearance of a Kinegram® patch can be seen in reflection, the patch providing a first optical security feature 110. FIG. 21*g* shows the optical effect of the security element 1 when viewed against a light background. Here, an optically variable effect can be seen in the form of a moiré magnification of stars, this effect providing a second optical security feature 120.

Moreover, it is advantageous to encode yet another item of information into the mask layer 4. Thus, it is possible, for example, as shown in FIG. 21*c*, to provide the mask layer 4 only in a patterned region, in this case the region of a portrait, and/or to vary the width of the openings 41 in the mask layer 4 and/or the width of the regions of the mask layer arranged between the openings 41 in the mask layer 4, for the purpose of generating a half-tone image, as represented as an example in FIG. 21*c*.

Preferably, the mask layer is realized in the form of a linear grid, wherein the period and shape of the lines is selected, for example, such that it acts in combination with the micro-images realized in the luminous layer, in order to generate the effects described above, and the line width or line thickness determines the grey value of the image.

Moreover, it is also possible, as shown in FIG. 21*d*, to design the mask layer 4 as a multicolored print. FIG. 21*d* shows a corresponding design of such a mask layer. Here, the opaque regions of the mask layer 4, between the openings 41, have a linear shape, wherein the coloring of the mask layer 4 varies in the color or color tone along these lines, in order thus to generate the multicolored image shown in FIG. 21*d*. Thus, for example, as shown in FIG. 21*d*, some of these linear or strip-shaped, opaque regions between the openings 41 are realized in a first color or a first color tone 43, and others are realized in a second color or color tone 44, which differs from the first.

As has already been stated above in connection with FIGS. 19*a* to 20*d*, the luminous layer 2 may have a multiplicity of separate luminous elements, the radiating region of which, i.e. the region in which the respective luminous elements can emit or provide light, realizes one of the first zones in each case, and is therefore in each case realized in the form of a micro-image. Moreover, it is also possible for the luminous layer 2 to have a mask layer that is not provided in the region of the first zones and that is provided in the region of the second zone or the second zones. Thus it is possible, for example, for the luminous layer 2 to have a metallic layer that is demetallized in the region of the first zones, i.e. that is not provided there, and that is provided in the region of the second zones, and thus has the effect that light provided or radiated by the luminous layer is provided or emitted only in the first zones, but is not provided or emitted in the second zones. Moreover, it is also possible for this mask layer to realize the reflection layer for a security feature provided in reflection in the luminous layer, e.g. a diffractive surface relief, and therefore for another, additional, e.g. diffractive, security feature to be provided by the luminous layer.

As has already been stated above, it is possible in this case for a multiplicity of first zones to be configured in the form of micro-images and arranged according to a grid, i.e. the micro-images appear light against a dark background when light is provided or emitted by the luminous layer 2. Moreover, however, it is also possible for the luminous layer to have a multiplicity of second zones that are each configured in the form of a micro-image and arranged according to the grid. In this case, the micro-images appear dark against a light background when light is provided or emitted by the luminous layer.

It is also possible in this case for the luminous layer 2 to be realized such that the light that is incident on the back side of the security document is provided in the region of the first zones by the luminous layer, with the result that, when the back side is correspondingly illuminated, the effect explained by way of example above with reference to the figures FIG. 21*a* to FIG. 21*d* is generated and, when viewed with reflected light, the optical information generated by the additional structuring of the mask layer, for example the optical information generated according to FIG. 21*a* to and FIG. 21*g*, and/or the optical information provided by the diffractive relief structure of the luminous layer 2, becomes visible.

The embodiments according to FIG. 19*a* to FIG. 21*g* explain embodiment examples in which the openings in the mask layer and the first and second zones of the luminous layer are arranged according to a periodic, one-dimensional grid.

It is also possible, moreover, for the openings 41 in the mask layer 4, and the first and second zones 211 and 212, respectively, of the luminous layer 2 to be arranged according to a two-dimensional grid, or according to a geometrically transformed grid, for example a grid extending in the form of a wave line or in a radially symmetrical manner. Moreover, it is also possible for these grids not to be periodic grids, and thus, for example, for the grid width of one or both of these grids to vary in at least one spatial direction and/or for the alignment to vary between these grids. This enables interesting optically variable effects to be generated, as already stated above.

Figure 22:
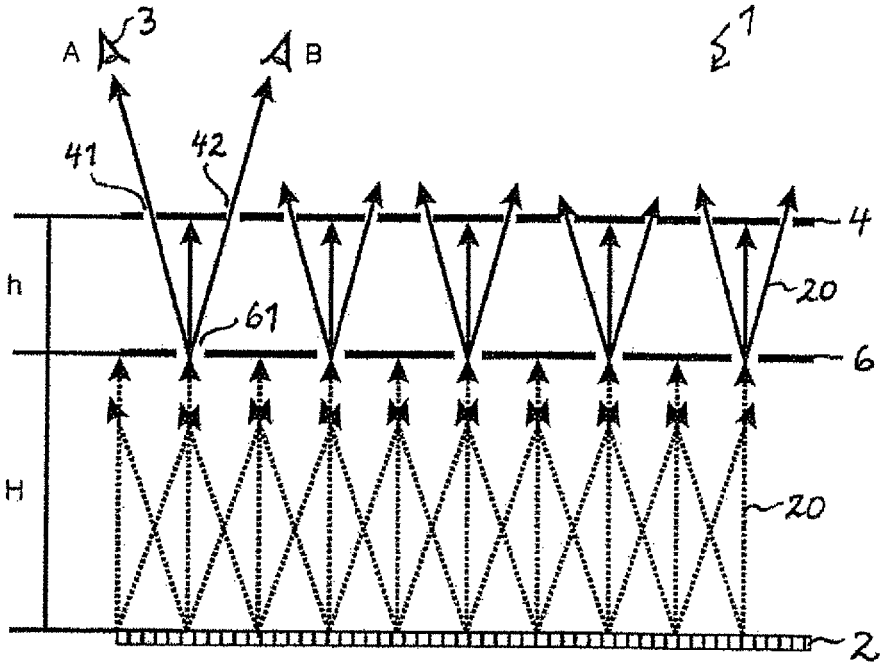
FIG. 22 an intermediate layer.

FIG. 22 shows a section of a security element, which has a luminous layer 2, a mask layer 4 having 2 arrangements 41, 42 of openings, and an intermediate layer 6, having transparent openings 61, that is arranged between the luminous layer 2 and the mask layer 4. The luminous layer 2 is a full-area, non-pixellated transparent OVD or a full-area OLED, with the result that the intermediate layer 6 delimits the light 20 emitted by the luminous layer 2 to particular positions 61, which are matched to the mask layer 4. The openings 61 in the intermediate layer 6 constitute, as it were, a linear arrangement of emitters that are matched to the mask layer 4 and that, for their part, in turn, radiate light 20, in that they re-transmit the light 20, received from the luminous layer 2, in the direction of the mask layer 4. The emergence angles in relation to the viewing positions A and B can be set through adaptation of the vertical distances h, between the mask layer 4 and the intermediate layer 6, and H, between the intermediate layer 6 and the luminous layer 2. In addition, the strength of the possible "crosstalk" can be defined.

Figure 23:
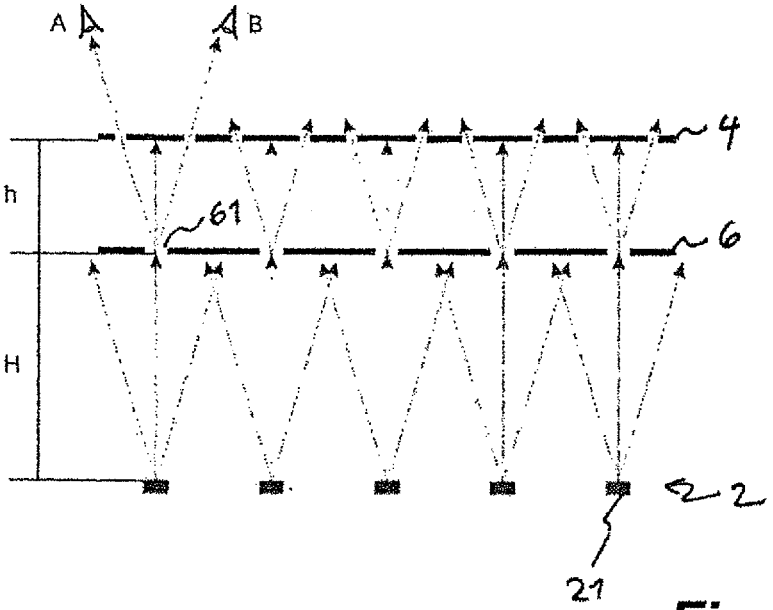
FIG. 23 a further intermediate layer.

Shown schematically in FIG. 23 is an intermediate layer 6 arranged between a mask layer 4 and a luminous layer 2, the latter being present as a pixel grid 21. In this connection, the intermediate layer is useful for solving the problem of angular resolution and crosstalk with pixelated luminous layers. The reason is that the vertical distance h between the intermediate layer 6 and the mask layer 4 may be much less than the vertical distance H between the intermediate layer 6 and the luminous layer 2. This is useful, in particular, if the luminous layer 2 is covered by a thick layer, e.g. H=0.7 mm, with the result that there is a large vertical distance between the luminous layer 2 and the mask layer 4. It may also be useful in this case if the transparent openings 61 in the intermediate layer 6 have a matt material, which diffusely scatters the light that is incident on the intermediate layer 6 from the luminous layer 2.

Figure 24:
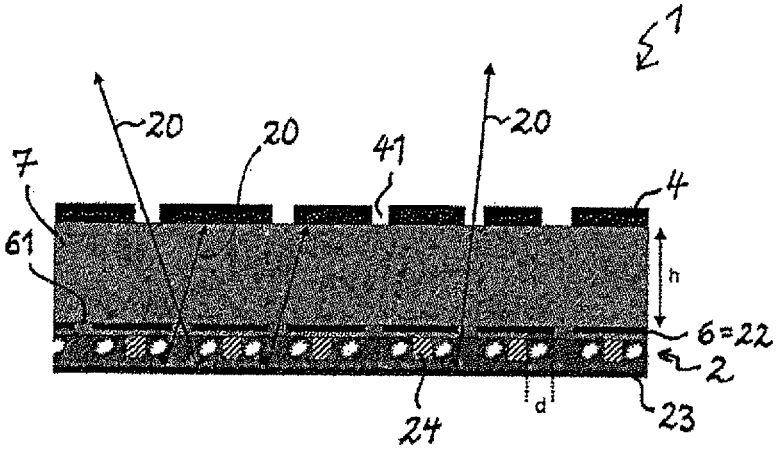
FIG. 24 a section of a security element having an LEEC.

FIG. 24 shows a section through a security element 1 that has a luminous layer 2 and a mask layer 4 arranged above the latter, wherein an intermediate layer 6, having an arrangement of transparent openings 61, is arranged between the luminous layer 2 and the mask layer 4. The mask layer 4 has an arrangement 41 of transparent openings, and is realized by a printed layer or metal layer. The mask layer 4 in this case has been applied to a substrate 7, which is composed, e.g., of a plastic film. In the present example, the substrate 7 is composed of a PET film which is 23 μm thick. The luminous layer 2, which is realized, e.g., as an LEEC, is arranged on the opposite side of the substrate 7. The luminous layer 2 has two electrode layers 22, 23, wherein the electrode layer 22 that is towards the mask layer 4 has openings 61, and thus functions simultaneously as intermediate layer 6. The electrode layer 22 is realized as a patterned aluminum or gold electrode. The first and second electrode layer 22, 23 preferably have a layer thickness in the range of from 1 nm to 500 nm. The electrode layers 22, 23 in this case may be realized opaque, or at least locally transparent. To create the electrode layers 22, 23, metals or metal alloys such as aluminum, silver, gold, chrome, copper or the like, conductive non-metallic, inorganic materials such as indium tin oxide (=ITO) and the like, carbon nanotubes and conductive polymers, such as PEDOT, PANI and the like have proved successful (PEDOT=poly(3,4-ethylenedioxythiophene; PANI=polyaniline). The electrode layers are preferably created, particularly in the case of creation of metallic or non-metallic inorganic electrode layers, by vapor deposition or sputtering or, particularly in the case of creation of polymer electrode layers, by standard printing methods such as screen printing, relief printing, gravure printing or blade application. However, it is also possible to use a transfer foil, to use electrode layers by means of stamping.

In the present example, in which the electrodes are composed of metal, their layer thickness is selected such that no light, or only very little light, can go through the electrodes, apart from through the transparent openings 61. The great advantage is of this embodiment example is that the distance h between the intermediate layer 6 and the mask layer 4 can be chosen very small. In addition, it is possible for the two electrode layers, in the regions in which there are no transparent openings 61, i.e. where no light can escape in any case, to be realized with an electrical insulating material 24, which electrically isolates the two electrode layers 22, 23 from each other, e.g. by patterned printing. This avoids unnecessary heating of the foil as a result of light generation, when the light cannot in any case exit the self-luminous luminous layer 2. The lateral distance d between the edges of a hole in the upper electrode 22 and the edge of the closest insulating material 24 is in the range of from 1 μm to 100 μm, preferably of between 5 μm and 20 μm.

Figure 25:
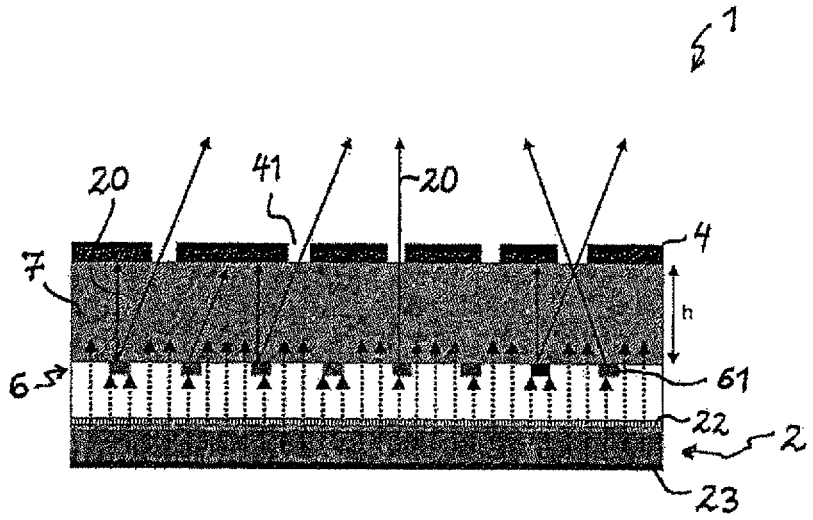
FIG. 25 a section of a security element having a fluorescent intermediate layer that is illuminated by an OLED integrated into the security element.

FIG. 25 shows a further embodiment example of a security element that, in addition to having a luminous layer 2 and a mask layer 4, has an intermediate layer 6. Arranged between the intermediate layer 6 and the mask layer 4 is the substrate 7, which is a substrate that absorbs, e.g., blue light, for example a dyed polyethylene film (PET film) having a thickness of 23 μm. The luminous layer 2 has two electrodes 22, 23, which are realized as ITO or semi-transparent Al or Ag electrodes. Alternatively, a conductive polymer, such as PEDOT:PSS material may be used (PSS=polystyrene sulfonate). The lower electrode 23 may also be composed of an opaque Al or Ag cathode. In this example, the luminous layer 2 emits blue light, which, owing to the opaque electrode layer 23, can only be radiated in the direction of the mask layer 4. There, it strikes the intermediate layer 6, which has printed fluorescent luminous elements 21 that serve, as it were, as transparent openings, since the substrate 7 is non-transparent to the blue light emitted by the luminous layer 2. Only the fluorescent light emitted by the fluorescent elements 61, which is green, can pass through the substrate 7 to the mask layer 4, and exit the security element 1 there via the transparent openings 41.

Figure 26:
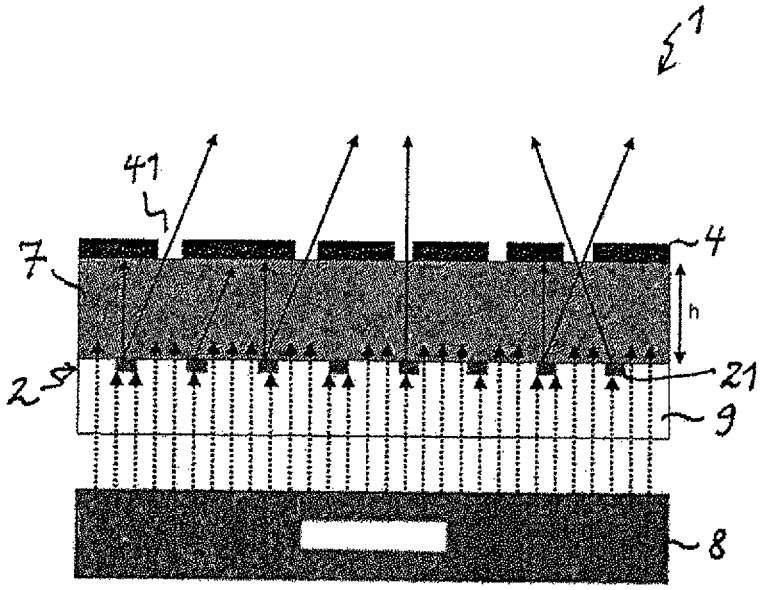
FIG. 26 a section of a security element having a fluorescent intermediate layer that is illuminated by an external lamp.

FIG. 26 shows an embodiment example of a security element 1 that, from the top downwards, has a mask layer 4, a UV-absorbing substrate, e.g. a PET film of a thickness of 23 μm, a printed fluorescent luminous layer 2, and a UV-transmissive protective layer 9. The security element 1 is irradiated by a UV lamp, from the side that has the protective layer 9. The UV light can pass through the protective layer 9 and reach the printed fluorescent luminous elements 21 of the luminous layer 2. There, the UV light is converted into green fluorescent light, which can pass through the UV-absorbing substrate 7 and reach the openings 41 in the mask layer 4. The pure UV light, on the other hand, is absorbed by the substrate 7.

Figure 27A:
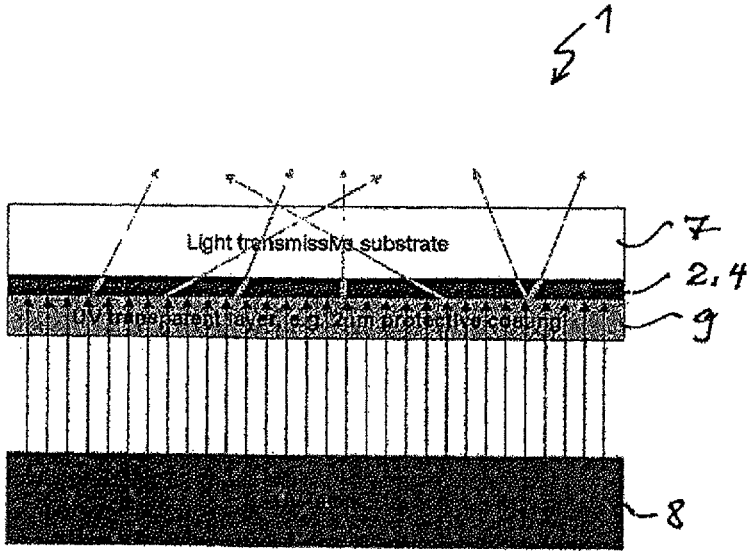
FIG. 27*a* a section of a security element, in which the luminous layer and the mask layer are combined in one layer.

FIG. 27*a* shows an example of a security element in which mask layer 4 and luminous layer 2 are combined in a single layer. A UV lamp 8 illuminates the security element and goes through a UV-transparent layer, e.g. a protective layer 9 of a thickness of 2 μm, to the combined luminous and mask layer 2,4. This combined luminous and mask layer 2,4 has through-holes, which are filled with a fluorescent material. The UV light of the UV lamp excites this material to fluoresce, with the result that the fluorescent light is radiated from the holes in the respective angular direction of the hole. This fluorescent light can pass unhindered through the light-transmissive substrate 7, and thus reach a viewer.

Figure 27B:
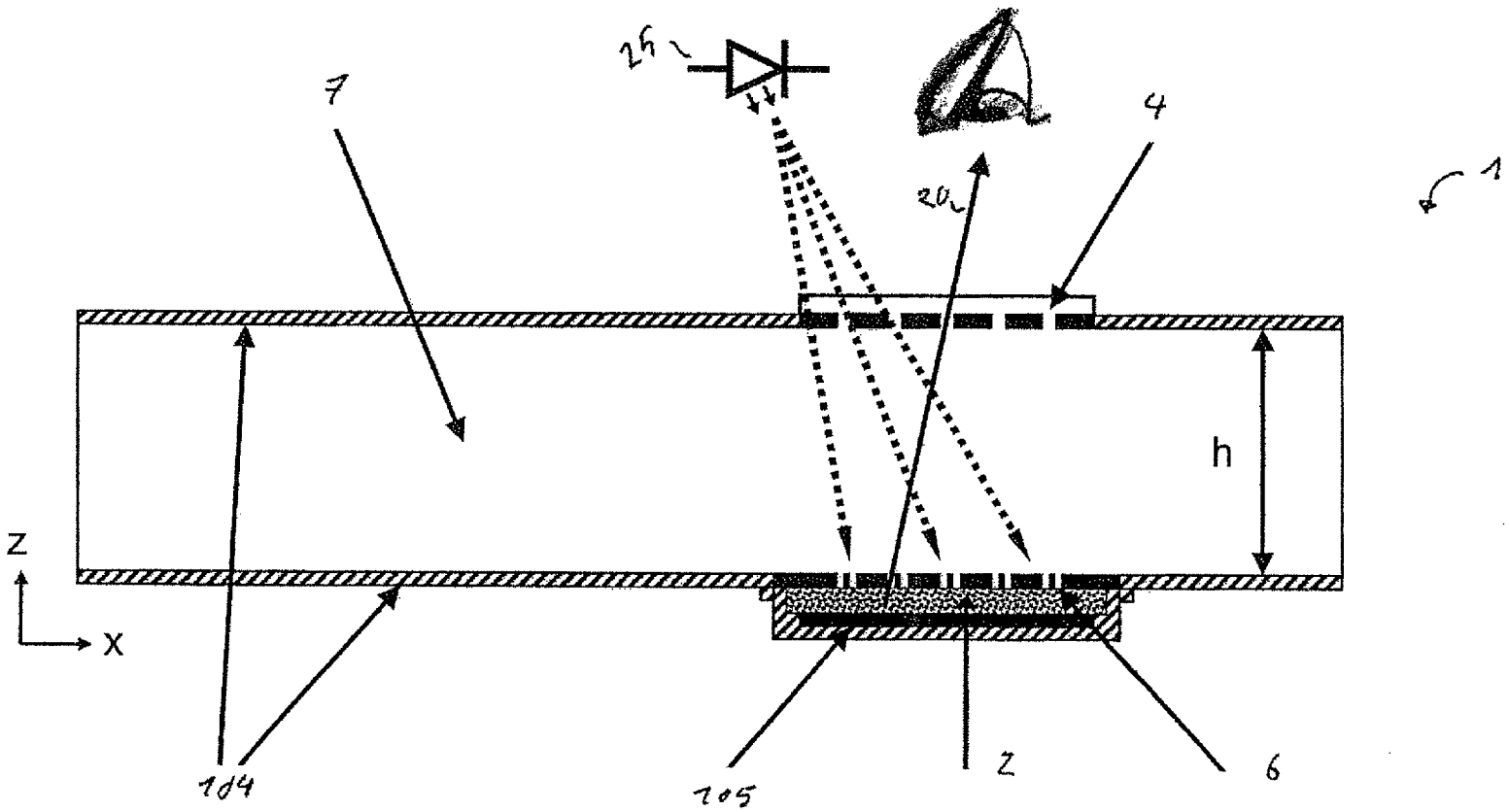
FIG. 27*b* a sectional representation of a portion of a security document having a security element.
Figure 27D:
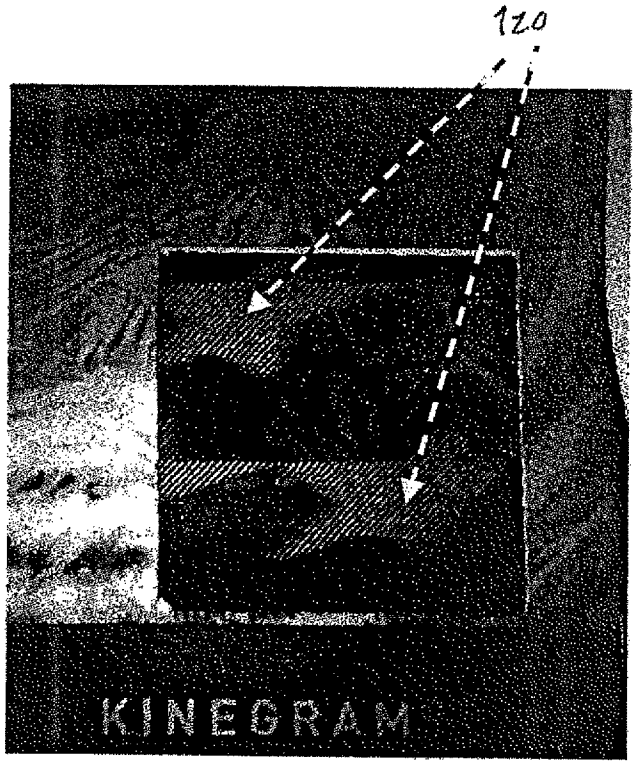
FIG. 27*c* and FIG. 27*d* Photos of the optical effect of the security element according to FIG. 27*b;*
Figure 27C:
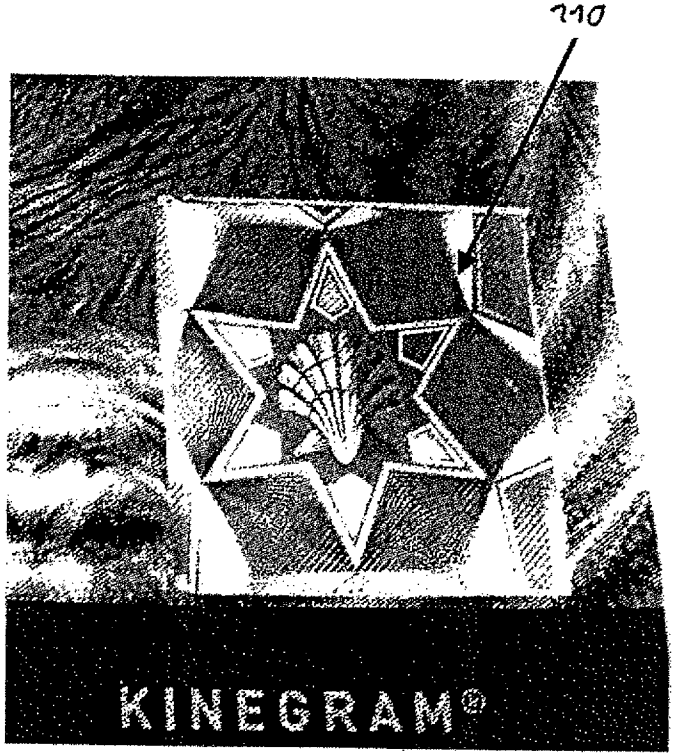

FIG. 27*b* shows a further example of a security element 1, which uses a luminescent, in particular a fluorescent or phosphorescent, layer as luminous layer 2. In this case also, as in the example of FIG. 21*e*, both the mask layer 4 and the luminous layer 2 may be applied as a foil element, for example as a laminating foil or a transfer layer of a transfer foil, or an optional printed layer 104 may be applied to the substrate 7. FIG. 27*b* shows this in a schematic side view of a banknote having a transparent core, i.e. transparent substrate 7. Light, e.g. UV light, of an external light source 25, e.g. of a UV-LED having a wavelength of 365 nm, illuminates the security element 1 from the viewing side. Some of the UV light passes through the mask layer 4, the transparent core of the substrate 7 (here, of a polymer banknote) and an intermediate layer 6, and then excites the luminous layer 2. The luminous layer 2 thereupon radiates light in the visible spectral range, e.g. green light. This radiated light passes through the intermediate layer 6 and the mask layer 4, through the transparent openings, and thereby generates the desired effect, e.g. moiré magnifications and/or movements. An optional mirror layer 105 behind the luminous layer 2 further increases the intensity of the light radiated in the direction of the viewing side. FIG. 27*c* and FIG. 27*d* show photos of the optical effects provided by the security element 1. FIG. 27*c* shows a photo of the security element 1 when viewed with reflected light. A Kinegram® patch, which exhibits an optically variable effect, and which provides a first optical security feature 110, can be seen in reflection. FIG. 27*c* shows a photo of the optical effect provided by the security element 1 when viewed under illumination with UV light from the viewing side. An optically variable effect of a moiré magnification of stars is now visible here, this effect providing a second optical security feature 120.

Figure 28:
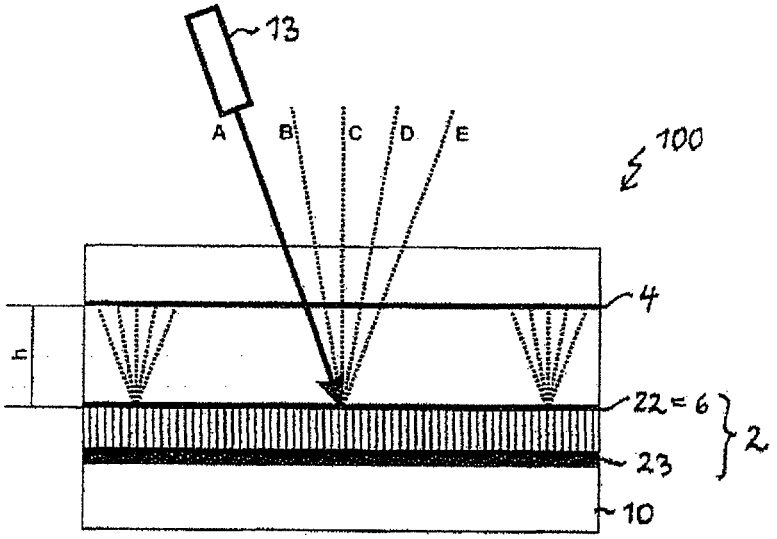
FIG. 28 an arrangement for the production of a security element.

FIG. 28 illustrates a method for producing a security element 1 that is arranged on a card core 10, e.g. a card core of an ID card (ID=identification). One of the difficulties in realizing such a security element is the accuracy of register between the various mask layers, or between the mask layer and the luminous layer. It is possible to use an ablation method, e.g. by means of a laser, for this purpose, in order to produce the mask layers in situ and thereby avoid the register problem.

Preferably, the card core is of a PCI design, although the method also works with other card types (PCI=Polycarbonate Inlay). FIG. 28 shows a first foil 4 and a second foil 22, which are arranged above one another, at a distance h, on the card core 10. Arranged beneath these two foils there is a luminous layer 2, which is thus located between the foils and the card core. Preferably, one of the foils is the upper electrode 22, although this foil may also be arranged at another position above the luminous layer 2. The upper foil 4 preferably provides a further security element, e.g. in the form of a reflection hologram or a Kinegram. This foil 4 may either lie on the upper surface of the card itself, or in one of the upper layers of the card, with a sufficient vertical distance from the lower foil 22. One of the two foils 4 and 22 is patterned or partially demetallized. The security document, in the form of the PCI card, is produced and finished apart from the final step of personalization. The card 100 is thus ready for the personalization step, which is performed by means of a high-power laser 13. Experiments had shown that the is energy required for the personalization of such a PCI card 100 is greater than the energy required for demetallization of a metallized Kinegram or a metallized foil.

As shown in FIG. 28, the card 100, in a personalization station, is held on a tilt device, with the result that the card can be tilted very precisely to various positions A to E. Alternatively, the card 100 is held flat, and the laser 13 is tilted. The items of text information and the portrait that are usual on an ID card are personalized by means of the laser 13 while the card is held flat. As is usual in the case of ID cards, in this case a local blackening can be generated in a laser-sensitive foil by the laser beam.

The mask may be produced using a method that has already been described by Jan van den Berg in "3-D Lenticular Photo ID" (in *Optical Document Security I*, Conference Proceedings, Editor Rudolf L. van Renesse, San Francisco, 23-25.01.2008, pages 337-344). The laser 13 scans the card 100 and uses high energy to remove material from the upper layer 4, in order to produce the item of information. The card 100 has between 2 and 7 tilt angles for which, respectively, the ablation process is performed. For each position A to E, the laser 13 removes a different pattern. The great advantage of this method is that the upper mask layer 4 and the lower intermediate layer 6 are written simultaneously, with the result that there is a perfect register accuracy between the two. The laser in this case is positioned at a relatively large distance from the card, with the result that the eyes of the viewer mirror the desired viewing direction.

Figure 29:
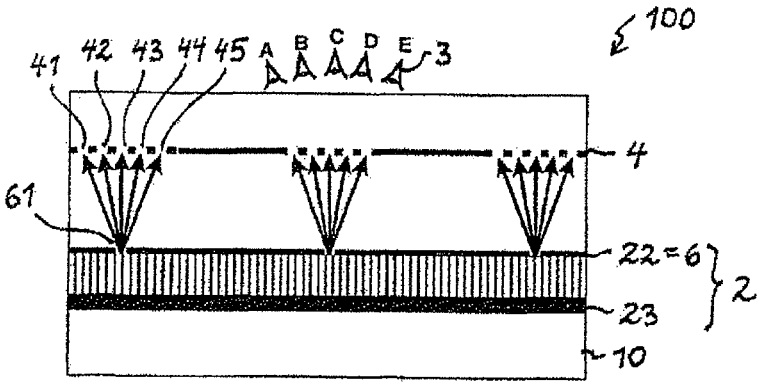
FIG. 29 a section of the security element produced by means of the arrangement shown in FIG. 29.

FIG. 29 shows the finished, personalized card 100 after the production step, having a having the arrangements 41 of openings in the mask layer 4 and the arrangement 61 of openings in the intermediate layer 6, the latter simultaneously being the upper electrode layer 22 of the luminous layer 2. This method can be used to generate 3D photo IDs with image changeover (image flip), etc., which can only be seen when the luminous layer 2 is active. It is important to state that the personalization and individualization can be realized just as easily as any other image, since this is only a matter of software control.

Figure 30:
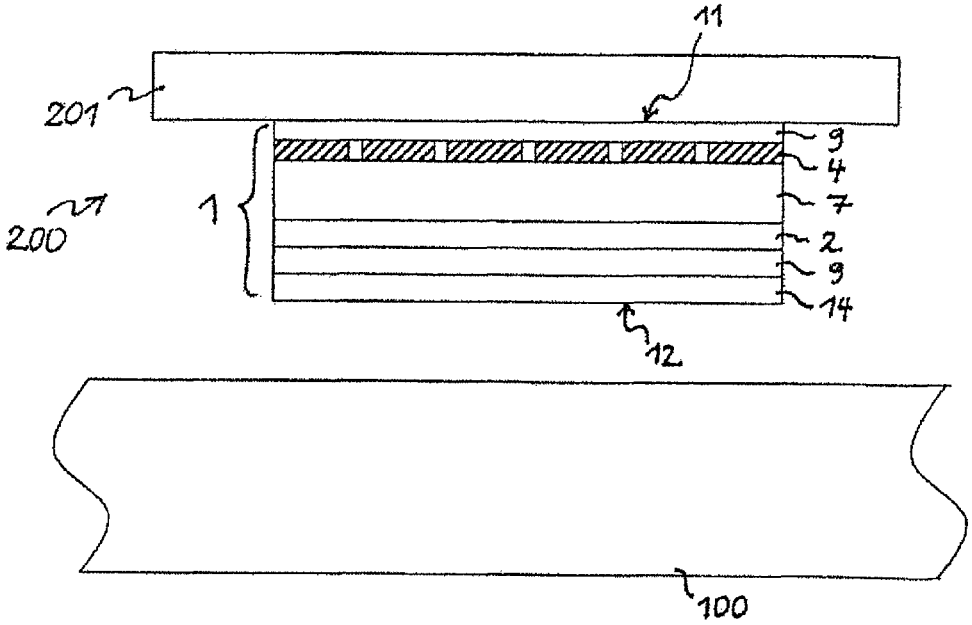
FIG. 30 a section of a transfer foil.

FIG. 30 shows a transfer foil 200. It has proved successful if the security element 1 realized as a foil body is provided in the form of a transfer foil 200, with the result that the security element 1 can be applied to a security document 100 by means of stamping. Such a transfer foil 200 has at least one foil body 1 to be transferred, wherein the at least one foil body 1 is arranged on a carrier foil 201 of the transfer foil 200 and is separable from the latter.

From the top downwards, the transfer foil 200 has the following structure: a carrier foil 201, an outer protective layer 9, which is preferably realized as a transparent protective varnish layer and the top side of which constitutes the viewing side 11 of the security element 1, a mask layer 4, e.g. in the form of an OVD, a substrate 7, e.g. 0.2 mm thick, a luminous layer 2, a lower protective layer 9, and an adhesive layer 14, the underside of which constitutes the underside 11 of the security element 1. The transfer foil 200 is oriented relative to a security document 100 to be provided with identification marking, such that the adhesive layer 14 faces towards the security document 100 and the carrier foil 201 faces away from the security document 100. The foil body 1 can be fixed to the security document 100 by means of the adhesive layer 14, in particular in the form of a cold-setting or hot-setting adhesive. A separation layer may additionally be arranged between the carrier foil 201 and the foil body 1, this layer making it easier to separate the foil body 1 from the carrier foil 201 of the transfer foil 20 after the stamping. However, this separation function may also be assumed by a different layer, e.g., as in the present example, by the upper protective layer 9.

Figure 31:
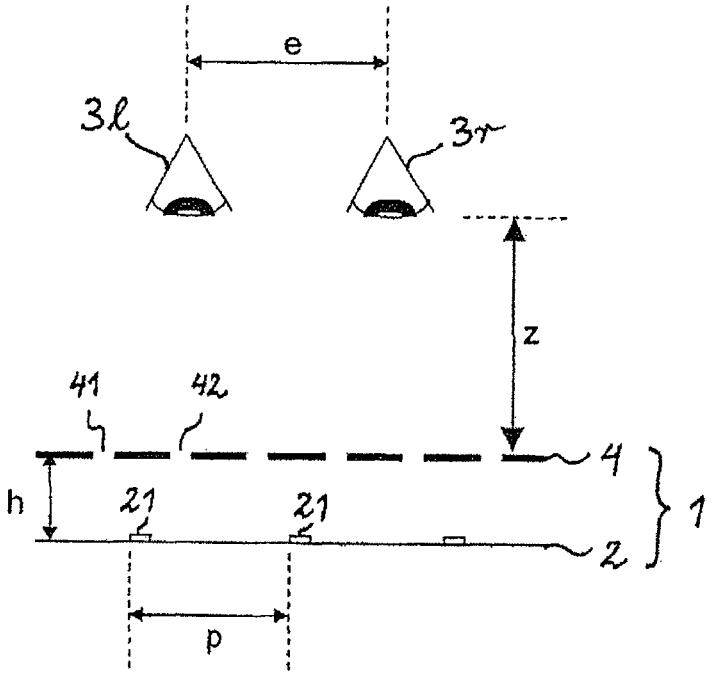
FIG. 31 a diagram relating to the viewing distance.

FIG. 31 shows a diagram relating to the viewing distance z. A viewer, whose eyes 3*l*, 3*r* have an eye separation e, views a security element 1 vertically from above, the latter having a mask layer 4, comprising two arrangements 41, 42 of transparent openings, and a luminous layer 2, which is arranged at a distance h behind the mask layer 4 in the viewing direction and which is constituted by individual luminous elements 21 in the form of pixels. The luminous elements 21 are arranged in a grid having a period p (="pitch"). One opening of each arrangement 41, 42 of openings is in each case assigned to a luminous element 21, wherein the viewer perceives differing images ("image flip") according to the emergence of light through one of the two openings 41 and 42. The eyes 3*l*, 3*r* are at a viewing distance z from the mask layer 4. The relationship between the distance h between the mask layer 4 and the luminous layer 2, the viewing distance z, the pixel pitch p and the eye separation e is described by the following formula:

$$h=z\cdot(p/(e+p))$$

If the pixel separation is made p=0.1 mm and the eye separation is made e=65 mm, then, for a typical viewing distance of z=200 mm for ID documents, the distance h, from the luminous layer 2 to the mask layer 4, is h=300 μm results. This is realizable for ID documents. Smaller pixels, with correspondingly smaller periods p, allow even smaller values for h.

LIST OF REFERENCES

1 security element
2 luminous layer
3 viewer
3*l* left eye

3*r* right eye
4 mask layer
5 opaque region of 4
6 intermediate layer
7 substrate
8 UV lamp
9 protective layer
10 card core
11 viewing side
12 underside
13 laser
14 adhesive layer
20 light
21 luminous elements
22, 23 electrode
24 insulating material
25 light source
30 reflection hologram
31 field of view
41, 42 arrangement of openings in 4
41*l*, 412 relief structure
43, 44 color
61 arrangement of openings in 6
100 security document
101 window
102, 103 region
104 printed layer
105 mirror layer
110, 120 optical security feature
200 transfer foil
201 carrier foil
211 first zone
212 second zone
A, B, C, D, E viewing position
Bl left image
Br right image
d lateral distance (distance)
e eye separation
h vertical distance (height)
O1, O2 object
p lateral distance (pitch)
$p_e$ first period (e=emitter)
$p_i$ second period (i=image)
R, G, B red, green, blue
s lateral distance (spacing)
z viewing distance
$\theta_1$, $\theta_2$ emergence angle

The invention claimed is:

1. A security element, wherein the security element has a viewing side and a back side that is opposite the viewing side, wherein the security element comprises at least one luminous layer that can provide light, and at least one mask layer that, when the security element is viewed from the viewing side, is arranged in front of the at least one luminous layer, and wherein the at least one mask layer is a metal layer having at least one opaque region and at least two transparent openings, and wherein each of the at least two transparent openings comprises a sub-wavelength grating structure having a period under 450 nm and a depth of greater than 100 nm, the sub-wavelength grating structure increasing the transmission of the at least two transparent openings of the metal mask layer by at least 20% in comparison with the at least one opaque region in respect of light emitted by the at least one luminous layer, and wherein the light that exits the security element through the mask layer, at differing emergence angles provides respectively differing items of optical information, and wherein the at least one opaque region of the at least one mask layer provides a second optical security feature of the security element, when the security element is viewed from the viewing side, which at least one mask layer is realized as an optically variable device (OVD).

2. A security element according to claim 1, wherein a first optical security feature of the security element is provided by a light pattern that is shown by the mask layer as a result of the latter differentially transmitting the light provided by the at least one luminous layer when the security element is viewed from the viewing side.

3. A security element according to claim 1, wherein the two or more transparent openings are arranged according to a second grid, and wherein the at least one luminous layer has two or more first zones, in which the luminous layer can provide light, and which are each surrounded, or separated from each other, by a second zone, in which the luminous layer cannot provide light, or the at least one luminous layer has two or more second zones, in which the luminous layer cannot provide light, and which are each surrounded, or separated from each other, by a first zone, in which the luminous layer can provide light, wherein the first zones or the second zones are arranged according to a first grid.

4. A security element according to claim 3, wherein the two or more transparent openings of the second grid are each configured in the form of a micro-image.

5. A security element according to claim 4, wherein the two or more first zones or the two or more second zones are configured in the form of a sequence of strips or pixels, as viewed perpendicularly in relation to a plane spanned by the viewing side or the back side of the security element.

6. A security element according to claim 4, wherein the grid width of the first and/or second grid and/or the angular offset of the first and the second grid relative to each other and/or the shape of the micro-images are varied continuously, according to a parameter variation function, in at least one spatial direction.

7. A security element according to claim 4, wherein the grid width of the first and/or second grid and/or the angular offset of the first and the second grid relative to each other and/or the shape of the micro-images in a first region of the security element differs from the grid width of the first or second grid, the angular offset of the first and the second grid relative to each other and the shape of the micro-images in a second region of the security element.

8. A security element according to claim 3, wherein the at least one luminous layer has two or more separate luminous elements, which each have a radiating region, in which the respective luminous element can provide light, and each of which constitutes one of the first zones.

9. A security element according to claim 3, wherein the luminous layer has a mask layer that is not provided in the region of the first zone, or the first zones, and that is provided in the region of the second zone, or the second zones.

10. A security element according to claim 3, wherein the transparent openings of the second grid or the two or more first zones or the two or more second zones of the first grid are each in the shape of a strip, and wherein the width of the strip-shaped openings, or strip-shaped first or second zones, is varied for the purpose of generating a half-tone image.

11. A security element according to claim 3, wherein the transparent openings, or the two or more first or second zones, are configured in the form of identical micro-images, or wherein two or more of the micro-images, according to which the transparent openings, or the first or second zones, are configured, differ from each other.

12. A security element according to claim 3, wherein the first grid is a one-dimensional or two-dimensional grid, and the second grid is a one-dimensional or two-dimensional grid, and wherein the grid width of the first grid and the grid width of the second grid in at least one spatial direction are less than 300 μm.

13. A security element according to claim 3, wherein the two or more first zones or two or more second zones of the first grid, and the transparent openings of the second grid, overlap, at least in regions, as viewed perpendicularly in relation to a plane spanned by the viewing side or back side of the security element.

14. A security element according to claim 3, wherein the grid widths of the first grid and of the second grid are not equal, for adjacent first zones and transparent openings, or second zones and transparent openings, respectively, and differ from each other by less than 10%.

15. A security element according to claim 3, wherein the first grid and the second grid are arranged with an angular offset of between 0.5 and 25 degrees relative to each other, and, the grid width of the first grid and the grid width of the second grid, for adjacent first zones and transparent openings, or second zones and transparent openings, differ from each other by less than 10%.

16. A security element according to claim 3, wherein the first grid is a periodic grid, having a first period as grid width, and/or the second grid is a periodic grid, having a second period as grid width.

17. A security element according to claim 3, wherein the two or more first zones or the two or more second zones are each configured in the form of a micro-image, as viewed perpendicularly in relation to a plane spanned by the viewing side or the back side of the security element.

18. A security element according to claim 1, wherein the at least one luminous layer has two or more separate luminous elements, which are arranged in a first periodic grid having a first period, and the two or more transparent openings are arranged in a second periodic grid having a second period, wherein the first and second period are not equal, but similar, wherein the first and second period differ from each other, by not more than 10%.

19. A security element according to claim 1, wherein the mask layer is arranged at a distance h above the luminous layer, as viewed perpendicularly in relation to the plane spanned by the viewing side or back side of the security element, wherein the distance h is chosen between 2 μm and 500 μm.

20. A security element according to claim 1, wherein the luminous layer has one or more first zones, into which the luminous layer can provide light, wherein one or more of the first zones has at least one lateral dimension of less than 300 μm.

21. A security element according to claim 1, wherein the at least one mask layer has at least two arrangements of transparent openings, wherein light provided by the at least one luminous layer exits the security element through the at least two arrangements at respectively differing emergence angles.

22. A security element according to claim 21, wherein the light exiting the security element through the at least two arrangements, at respectively differing emergence angles, realizes an image sequence consisting of two or more images, wherein each of these images is present at a different emergence angle.

23. A security element according to claim 21, wherein the at least one luminous layer has two or more separate luminous elements, arranged in a pattern, and the transparent openings of the at least two arrangements are realized so as to match this pattern, wherein at least one opening is assigned, respectively, to a luminous element, through which opening light, provided by the luminous element, exits the security element at an assigned emergence angle in each case.

24. A security element according to claim 1, wherein the at least one luminous layer and the at least one mask layer are arranged parallel to each other.

25. A security element according to claim 1, wherein arranged, at least partially, between the at least one luminous layer and the at least one mask layer there is at least one opaque intermediate layer, which has at least one arrangement of translucent openings.

26. A security element according to claim 25, wherein light-scattering or luminescent elements are arranged in the translucent openings in the intermediate layer, which elements scatter incident light from the luminous layer in the direction of the mask layer, or re-radiate it by luminescence.

27. A security element according to claim 1, wherein the at least one luminous layer has two or more separate luminous elements, wherein these luminous elements and the at least two transparent openings in the mask layer have a rectangular shape, as viewed perpendicularly in relation to the plane of the foil body.

28. A security element according to claim 1, wherein the at least one luminous layer has two or more separate luminous elements, wherein a distance between adjacent luminous elements is approximately 5 times greater than a width of the luminous elements.

29. A security element according to claim 1, wherein the at least one luminous layer has two or more luminous elements that provide light in at least two differing colors.

30. A security element according to claim 1, wherein the at least one luminous layer has a luminescent display element, which can be excited by another light source to give light.

31. A security element according to claim 1, wherein the luminous layer that can provide light is a layer that conducts to the mask layer light that is incident on the back side.

32. A security element according to claim 1, wherein the security element is realized in the form of a flexible, multilayer foil body for the identification marking of a security document and increasing the security against falsification of the latter, or of an identification document, or of a commercial product, for the purpose of increasing the security against falsification and/or for the purpose of authentication and/or traceability (track & trace) of the commercial product.

33. A security element according to claim 1, wherein the security element is a banknote, a monetary instrument, an ID document or a credit card.

34. A security document, having at least one security element according to claim 1, wherein the security element can be viewed from its viewing side.

35. A security document according to claim 34, wherein the security document has a maximum thickness of 200 μm.

36. A security document according to claim 34, wherein the at least one security element is arranged on or embedded in the security document.

37. A transfer foil having at least one security element according to claim 1, wherein the at least one security element is arranged on, and can be separated from, a carrier foil of the transfer foil.

* * * * *